US010518938B2

(12) United States Patent
Suzuki et al.

(10) Patent No.: US 10,518,938 B2
(45) Date of Patent: Dec. 31, 2019

(54) CONTAINER

(71) Applicant: SUNTORY HOLDINGS LIMITED, Osaka (JP)

(72) Inventors: Yuuji Suzuki, Tokyo (JP); Masatoshi Aihara, Tokyo (JP); Hiroki Yokoyama, Tokyo (JP)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 15/559,254

(22) PCT Filed: Mar. 17, 2016

(86) PCT No.: PCT/JP2016/058429

§ 371 (c)(1),
(2) Date: Sep. 18, 2017

(87) PCT Pub. No.: WO2016/148220

PCT Pub. Date: Sep. 22, 2016

(65) Prior Publication Data

US 2018/0079559 A1 Mar. 22, 2018

(30) Foreign Application Priority Data

Mar. 19, 2015 (JP) ..... 2015-056964
Jul. 21, 2015 (JP) ..... 2015-144274

(51) Int. Cl.
*B65D 35/28* (2006.01)
*B67D 1/08* (2006.01)
(Continued)

(52) U.S. Cl.
CPC ..... *B65D 35/28* (2013.01); *B65D 35/08* (2013.01); *B65D 35/10* (2013.01); *B65D 75/566* (2013.01);
(Continued)

(58) Field of Classification Search
CPC ..... B65D 35/28; B65D 85/72; B65D 75/566; B65D 35/08; B65D 35/10; B65D 83/0055;
(Continued)

(56) References Cited

U.S. PATENT DOCUMENTS 3,418,059 A 12/1968 Robe
4,088,166 A * 5/1978 Miller ..... A61J 1/00 222/107
(Continued)

FOREIGN PATENT DOCUMENTS

JP 08-199348 5/1996
JP H08-119348 5/1996
(Continued)

OTHER PUBLICATIONS

U.S. Appl. No. 15/559,202 to Yuuji Suzuki et al., filed Sep. 18, 2017.
(Continued)

*Primary Examiner* — Paul R Durand
*Assistant Examiner* — Robert K Nichols, II
(74) *Attorney, Agent, or Firm* — Greenblum & Bernstein, P.L.C.

(57) ABSTRACT

A container is provided to contain a liquid to be used in a liquid dispenser that is space-saving and enables checking of the amount of remaining liquid, a refilling operation, and maintenance to be readily performed. A stock solution container in which a concentrated stock solution is to be contained and that is to be used in a beverage dispenser to eject a beverage constituted by the concentrated stock solution and a diluent includes: a containing portion having a bag shape and is to contain the concentrated stock solution; and an ejecting portion for ejecting the concentrated stock solution to the outside, the ejecting portion being provided to protrude from the containing portion. An ejection port is provided at a leading end of the ejecting portion, and the concentrated stock solution is ejected from the ejection port as the containing portion deforms based on an external force.

11 Claims, 11 Drawing Sheets

(51) Int. Cl.

| | |
|---|---|
| ***B65D 75/58*** | (2006.01) |
| ***B65D 83/00*** | (2006.01) |
| ***B67D 1/10*** | (2006.01) |
| ***B65D 35/08*** | (2006.01) |
| ***B65D 35/10*** | (2006.01) |
| ***B65D 75/56*** | (2006.01) |
| ***B65D 85/72*** | (2006.01) |
| ***B67D 1/00*** | (2006.01) |

(52) U.S. Cl.
CPC ..... *B65D 75/5811* (2013.01); *B65D 83/0055* (2013.01); *B65D 85/72* (2013.01); *B67D 1/0001* (2013.01); *B67D 1/004* (2013.01); *B67D 1/0039* (2013.01); *B67D 1/0061* (2013.01); *B67D 1/0071* (2013.01); *B67D 1/0079* (2013.01); *B67D 1/0807* (2013.01); *B67D 1/0871* (2013.01); *B67D 1/10* (2013.01); *B67D 1/0021* (2013.01); *B67D 1/0057* (2013.01); *B67D 1/108* (2013.01); *B67D 2001/0093* (2013.01); *B67D 2001/082* (2013.01); *B67D 2001/0827* (2013.01)

(58) Field of Classification Search
CPC ..... B65D 75/5811; B65D 88/58; B65D 2231/001; B67D 1/0039; B67D 1/0071; B67D 1/0079; B67D 1/0871; B67D 1/004; B67D 1/0001; B67D 2001/0827
USPC ..... 222/214, 92, 95
See application file for complete search history.

(56) References Cited

U.S. PATENT DOCUMENTS

| | | | | |
|---|---|---|---|---|
| 5,333,758 | A * | 8/1994 | Jamison | B65D 75/5811 222/101 |
| 5,697,525 | A * | 12/1997 | O'Reilly | A47K 5/1209 222/105 |
| 8,727,156 | B2 * | 5/2014 | Skwarek | B65D 75/366 206/469 |
| 2003/0017066 | A1 | 1/2003 | Danby et al. | |
| 2003/0230604 | A1 | 12/2003 | Huffer | |
| 2006/0182370 | A1 * | 8/2006 | Risgalla | B65D 75/5822 383/44 |
| 2007/0068969 | A1 * | 3/2007 | Orzech | B67D 1/108 222/214 |
| 2013/0214000 | A1 * | 8/2013 | Stratton | B65D 1/0462 222/95 |

FOREIGN PATENT DOCUMENTS

| | | |
|---|---|---|
| JP | 2006-232328 | 9/2006 |
| JP | 2006232328 | 9/2006 |
| JP | 2012-146086 | 8/2012 |
| WO | 94/15852 | 7/1994 |
| WO | 2013/036564 | 3/2013 |

OTHER PUBLICATIONS

Search Report issued in Patent Application No. PCT/JP2016/058429, dated Jun. 21, 2016, with English translation.
Written Opinion issued in Patent Application No. PCT/JP2016/058429, dated Jun. 21, 2016, with English translation.
IPRP in Patent Application No. PCT/JP2016/058429, dated Sep. 28, 2017.
Official Communication issued in European Patent Office (EPO) Patent Application No. 16765049.8, dated Nov. 2, 2018.
China Office Action conducted in counterpart China Appln. No. 201610158102.5 (dated May 5, 2019).
Taiwan Office Action conducted in counterpart Taiwan Appln. No. 105108552 (dated May 30, 2019).

* cited by examiner

CONTAINER

TECHNICAL FIELD

The present invention relates to a container that is to contain a liquid and is to be used in a liquid dispenser for ejecting liquid from the container containing the liquid.

BACKGROUND ART

A liquid dispenser is an apparatus that ejects a liquid in accordance with a user operation.

A beverage dispenser that ejects a beverage, which serves as an example of liquid, into a cup C or the like is known as an example of the aforementioned liquid dispenser.

As shown in FIG. 11, a conventional beverage dispenser 101 is provided with a dispenser body 102 that includes: an accommodating portion 104 for accommodating a plurality of bag-in-boxes (hereinafter, "BIBs") 130 each containing a concentrated stock solution, which serves as an example of a liquid and is to be diluted with a diluent to constitute a non-carbonated beverage; a stock solution ejection mechanism 105 for ejecting a concentrated stock solution of a non-carbonated beverage from the BIBs 130 contained in the container portion 104; a diluent nozzle 118 that is provided at a terminal of a drinking water supply line 108 to supply drinking water (diluent) for diluting the ejected concentrated stock solution of a non-carbonated beverage; a carbonated water supply mechanism 113 for carbonated water (diluent) for diluting a concentrated stock solution of carbonated beverage, which is ejected from a stock solution supply line 117; a cooling bath 115 for the carbonated water supply mechanism 113 and the stock solution supply line 117; and so on, and is also provided with a drinking water supply mechanism 107 for generating drinking water using tap water and supplying the drinking water as the diluent to the dispenser body 102, a gas cylinder 109 containing carbon dioxide gas, a syrup tank 120 storing a concentrated stock solution, which serves as an example of a liquid and is to be diluted with a diluent to constitute a carbonated beverage, therein, a syrup supply mechanism 121 for a concentrated stock solution of a carbonated beverage, and so on.

Each of the BIBs 130 is formed by accommodating, in a box-shaped corrugated case, a bag-shaped, flexible resin container in which a concentrated stock solution of a sugar-free beverage, which is mainly tea or the like, is contained. One end of a flexible resin tube 111 is in communication with the bag-shaped container, and the concentrated stock solution is ejected from an ejection port 119 at the other end of this tube 111. Since sugar-free beverages need to be cooled, the BIBs 130 are accommodated within the dispenser body 102.

On the other hand, a concentrated stock solution of a sugared beverage, which is mainly cider or the like, is contained in the syrup tank 120, and is arranged together with the gas cylinder 109 outside the dispenser body 102, e.g. below a mount on which the beverage dispenser 101 is installed, or a stock/supply room of a store.

The diluent for diluting a concentrated stock solution is drinking water if the concentrated stock solution to be diluted is for a non-carbonated beverage, and is carbonated water if the concentrated stock solution to be diluted is for a carbonated beverage. If the concentrated stock solution to be diluted is for a semi-carbonated beverage, drinking water and carbonated water are used as diluents.

The drinking water supply mechanism 107 for drinking water includes a purification mechanism for purifying tap water.

The drinking water supply mechanism 107 for drinking water and the diluent nozzle 118 are connected to each other via the drinking water supply line 108.

The carbonated water supply mechanism 113 includes a carbonated water supply line 114 for supplying carbonated water that is a so-called carbonator for mixing carbon dioxide gas in the gas cylinder 109 with drinking water supplied from a branch line 112, which branches from the drinking water supply line 108, and generating carbonated water to serve as a diluent to dilute a concentrated stock solution of a carbonated beverage.

The syrup supply mechanism 121 for a concentrated stock solution of a carbonated beverage is for supplying the concentrated stock solution in the syrup tank 120 to the dispenser body 102 using the carbon dioxide gas in the gas cylinder 109. The syrup supply mechanism 121 and the carbonator provided in the dispenser body 102 are connected to each other via the stock solution supply line 117. This stock solution supply line 117 passes through the cooling bath 115 within the dispenser body 102. The carbonated water and the concentrated stock solution of a carbonated beverage are cooled down to a predetermined temperature as a result of passing through the cooling bath 115. The carbonated water that has been refined in the carbonator is ejected into a cup C from a carbonated beverage discharge port 116 together with the concentrated stock solution supplied from the stock solution supply line 117.

The dispenser body 102 has an openable/closable door 103 in its front face. An operation unit, which includes a selection button or the like, is arranged in a front face of the door 103. The door 103 is usually closed and locked, but is opened when the BIBs 130 are being replaced or when maintenance is performed on the dispenser body 102, for example.

Inside the door 103, a tube pump mechanism is provided as a stock solution ejection mechanism 105 below the accommodating portion 104 for the BIBs 130. The tube pump mechanism is for ejecting concentrated stock solutions contained in the BIBs 130, and is provided for each of the BIBs 130. The diluent nozzle 118 is arranged next to the ejection port 119 below the tube pump mechanism, and a cup rest 106 for the cup C, which is a beverage vessel, is provided therebelow. Note that the cup rest 106 includes a drip tray for receiving the concentrated stock solution and diluent that has spread from the ejection port 119 and the diluent nozzle 118, as well as the beverage that has poured out of the cup C.

Upon a user operating an operation panel on the door 103, the tube pump mechanism is driven, which is provided corresponding to a BIB 130 in which a concentrated stock solution of selected tea, juice, or the like is contained, and the concentrated stock solution and a diluent are ejected into the cup C. Otherwise, carbon dioxide gas is supplied from the gas cylinder 109 to the syrup tank 120 in which a concentrated stock solution is stored of a selected carbonated beverage to send it under pressure, and the concentrated stock solution and carbonated water are ejected into the cup C.

PRIOR ART DOCUMENTS

Patent Documents

Patent Document 1: JP 2012-146086A

DISCLOSURE OF THE INVENTION

Problem to be Solved by the Invention

In the above-described conventional beverage dispenser 101, the syrup tank 120 is arranged together with the gas cylinder 109 outside the dispenser body 102, e.g. below the mount on which the beverage dispenser 101 is installed, or in a stock/supply room of a store. For this reason, a space for installing the syrup tank 120 is required separately from a space for installing the dispenser body 102.

In addition, since the BIBs 130 and the syrup tank 120 are installed at different locations, checking of the amount of remaining concentrated stock solution and operations to replace the BIBs 130 and to refill the syrup tank 120 need to be performed at different locations. Furthermore, an operation to handle the stock solution supply line 117 to connect the syrup tank 120 to the dispenser body 102 at initial installation and a washing operation after installation are troublesome, and installation costs and maintenance costs are high.

The invention has been made in view of the foregoing situation, and aims to provide a container that is to contain a liquid and is to be used in a liquid dispenser that is space-saving and enables checking of the amount of remaining liquid, a refilling operation, and maintenance to be readily performed.

Means for Solving Problem

A characteristic configuration of a container according to the present invention lies in a container that is to contain a liquid and is to be used in a liquid dispenser for ejecting the liquid from the container containing the liquid, including: a containing portion that has a bag shape and is to contain the liquid; and an ejecting portion for ejecting the liquid to the outside, the ejecting portion being provided so as to protrude from the containing portion, wherein an ejection port is provided at a leading end of the ejecting portion, and the liquid is ejected from the ejection port as the containing portion deforms based on an external force.

For example, a liquid dispenser for ejecting a liquid from a container containing the liquid is a beverage dispenser for ejecting a concentrated stock solution from a stock solution container containing the concentrated stock solution. If the container in which liquid is to be contained and that is to be used in a liquid dispenser for ejecting the liquid from the container containing the liquid according to the present invention is applied to the stock solution container containing the concentrated stock solution, not only a stock solution container in which a concentrated stock solution of a non-carbonated beverage, the concentrated stock solution serving as the liquid, is contained but also a stock solution container containing a concentrated stock solution of a carbonated beverage, the concentrated stock solution serving as a liquid, are accommodated in the accommodating portion of the beverage dispenser. As a result, a syrup tank for a concentrated stock solution of a carbonated beverage does not need to be installed outside the beverage dispenser as in the conventional technique, and accordingly, space can be saved. In addition, since an operation to handle a stock solution supply line or the like and a washing operation are not necessary, installation costs and maintenance costs can be reduced.

At this time, unlike a conventional BIB, the bag-shaped container itself can be used as the stock solution container in the beverage dispenser, without being accommodated in a box-shaped case. Accordingly, the space for the box-shaped case can be saved. Note that, with the same accommodating space, larger stock solution containers or more stock solution containers can be accommodated, and accordingly, space can be relatively saved.

Furthermore, an operation to replace the stock solution container is also facilitated because an operation to open a box-shaped case as in the case of using a conventional BIB is not necessary. Since a box-shaped case is not necessary, a reduction in material costs and manufacturing costs can be achieved. Furthermore, since a box-shaped case is not present, an operation to dispose an empty stock solution container is also facilitated.

As a result of accommodating, in the accommodating portion of the beverage dispenser, not only a stock solution container containing a concentrated stock solution of a non-carbonated beverage but also a stock solution container containing a stock solution container of a carbonated beverage, a syrup tank for a concentrated stock solution of a carbonated beverage does not need to be installed outside the beverage dispenser as in the conventional technique. Accordingly, space can be saved.

Since the concentrated stock solution contained inside can be ejected from the ejection port with a simple operation to deform the containing portion, a configuration of a concentrated stock solution ejection mechanism to be provided in the beverage dispenser can be simplified.

In the present invention, it is preferable that the containing portion and the ejecting portion are formed by folding one flexible resin sheet or laying a plurality of sheets over one another, and heat-sealing a peripheral portion thereof.

Since the container can be sealed, there is no concern that outside air, microorganisms, or the like will be mixed in, and the quality can be readily maintained.

Since the container is formed with a resin sheet, the containing portion can be readily deformed in order to eject the liquid contained therein.

Also, since the container is formed with a resin sheet, the liquid contained therein can be readily cooled only by cooling the container from the outside using a cooling mechanism, for example.

In the present invention, it is preferable that the ejecting portion is configured so that a volume of the liquid to be contained in the ejecting portion is a volume that corresponds to an amount of liquid that is ejected at a time from the liquid dispenser when the container is used in the liquid dispenser.

When the container is used in the liquid dispenser, a predetermined unit amount of the liquid contained in the ejecting portion can be ejected at a time by a liquid ejection mechanism provided in the liquid dispenser.

In the present invention, it is preferable that a cross-sectional area of the ejecting portion in a direction perpendicular to an axial direction of the ejecting portion is set to be narrower than that of the containing portion.

By making the ejection port narrow, the amount of liquid to be ejected can be readily controlled carefully.

In the present invention, it is preferable that the containing portion has, in a region bordering the ejecting portion, a transitional portion whose cross-sectional area in the direction perpendicular to the axial direction of the ejecting portion smoothly decreases from the containing portion to the ejecting portion.

The cross-sectional area of the ejecting portion in the direction perpendicular to the axial direction of the ejecting portion is set to be narrower than that of the containing portion. For this reason, pressure loss tends to increase in the border region between the containing portion and the ejecting portion.

Due to the presence of the transitional portion, pressure loss can be reduced by smoothly changing the cross-sectional area in the border region between the containing portion and the ejecting portion and the bulging of the container caused by the liquid. In addition, since the shape smoothly changes from the containing portion to the ejecting portion due to the transitional portion, the occurrence of wrinkles is suppressed in the border region between the containing portion and the ejecting portion. As a result, the liquid contained in the containing portion smoothly flows down to the ejecting portion.

In the present invention, it is preferable that the containing portion has a recessed portion that expands in a fan shape around a center of the transitional portion and is recessed in a thickness direction of the containing portion.

The cross-sectional area of the ejecting portion in the direction perpendicular to the axial direction of the ejecting portion is set to be narrower than that of the containing portion. For this reason, pressure loss tends to increase in the border region between the containing portion and the ejecting portion. By providing the recessed portion in the containing portion, the change in the cross-sectional area between the containing portion and the ejecting portion is made smoother at the recessed portion. Therefore, pressure loss can be reduced. Accordingly, the liquid contained in the containing portion smoothly flows down to the ejecting portion.

In the present invention, it is preferable that the containing portion has a protruding portion that vertically divides the transitional portion and externally protrudes as viewed in a cross-section in the direction perpendicular to the axial direction of the ejecting portion.

The internal pressure generated due to the liquid contained in the containing portion is exerted outward thereof on the inner face of the containing portion. At this time, the internal pressure is exerted on the inner face of the protruding portion, and the containing portion is opened in the thickness direction. Accordingly, the liquid contained in the containing portion can be caused to reliably flow down to the ejecting portion.

In the present invention, it is preferable that a lower end of the protruding portion reaches the leading end of the ejecting portion.

The internal pressure generated due to the liquid that flows through the ejecting portion is exerted outward thereof on the inner face of the ejecting portion. At this time, the internal pressure is exerted on the inner face of the protruding portion, and the ejecting portion is opened in the thickness direction. Accordingly, the liquid that flows through the ejecting portion can be caused to reliably flow down to the ejection port.

In the present invention, it is preferable that a cross-section of the ejecting portion in the direction perpendicular to the axial direction of the ejecting portion is configured to be circular.

The liquid that flows through the ejecting portion can be caused to reliably flow down to the ejection port.

In the present invention, it is preferable that the ejecting portion has, at the leading end thereof, a linear reinforcing portion that is parallel to the axial direction of the ejecting portion.

The reinforcing portion can reduce shaking of the leading end of the ejecting portion when the liquid is ejected.

In the present invention, it is preferable that the sheet is made of a resin that has excellent transparency.

It is easy to identify the liquid contained in the container, visually check the amount of remaining liquid, and to recognize a color change, turbidity, or the like.

In the present invention, it is preferable that a cutout portion capable of being used to form the ejection port is provided in a peripheral portion of the ejecting portion near the leading end.

By cutting off the ejecting portion from the cutout portion with, for example, fingers, scissors, or the like that have been sterilized using an alcohol spray, an open end to serve as the ejection port can be readily formed at the leading end.

In the present invention, it is preferable that a suspension hole for hanging the container on a hook provided in the liquid dispenser is provided in a peripheral portion of the containing portion on a side opposite to the ejecting portion.

The container can be accommodated in the liquid dispenser with a simple operation to hang the container at the suspension hole on the hook.

In the present invention, it is preferable that the liquid is a beverage.

It is possible to configure a container that is to contain a beverage and is to be used in a beverage dispenser that is space-saving and allows checking of the amount of remaining beverage, a refilling operation, and maintenance to be readily performed.

In the present invention, it is preferable that the liquid is a concentrated stock solution that constitutes a beverage by being mixed with a diluent.

It is possible to configure a container that is to contain a concentrated stock solution and is to be used in a beverage dispenser that is space-saving and allows checking of the amount of remaining concentrated stock solution, a refilling operation, and maintenance to be readily performed.

In the present invention, it is preferable that a second valve body is arranged in a flow path from the ejecting portion to the ejecting port, in the ejecting portion on the ejection port side. A preferable example of this second valve body is a relief valve that is opened when a predetermined amount of pressure is applied thereto.

BRIEF DESCRIPTION OF THE DRAWINGS

FIG. 3(A) is a perspective view showing a state before the stock solution container is accommodated in the beverage dispenser, and FIG. 3(B) is a perspective view showing a state after the stock solution container is accommodated in the beverage dispenser.

FIG. 4(A) is a diagram illustrating a state during preparation, FIG. 4(B) is a cross-sectional view showing a state before ejection, and FIG. 4(C) is a diagram illustrating a state during ejection.

FIG. 5(A) is a diagram illustrating a state during preparation, FIG. 5(B) is a cross-sectional view showing a state before ejection, and FIG. 5(C) is a diagram illustrating a state during ejection.

FIG. 6(A) is a diagram illustrating a state during preparation, FIG. 6(B) is a cross-sectional view showing a state before ejection, and FIG. 6(C) is a diagram illustrating a state during ejection.

FIG. 7(A) is a diagram illustrating a state during preparation, FIG. 7(B) is a cross-sectional view showing a state before ejection, and FIG. 7(C) is a diagram illustrating a state during ejection.

BEST MODE FOR CARRYING OUT THE INVENTION

Figure 1:
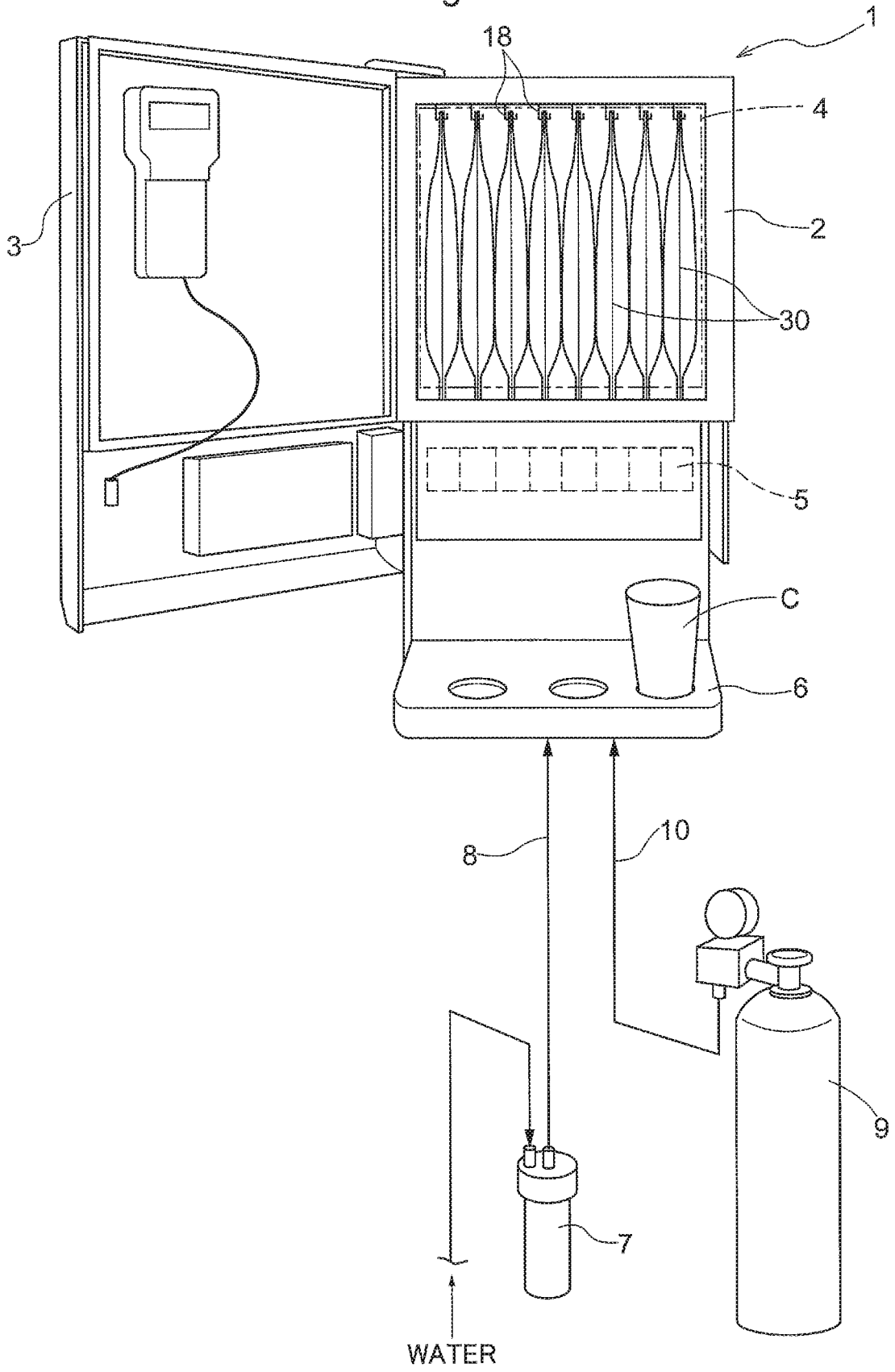
FIG. 1 is a diagram illustrating a state where a door of a beverage dispenser, in which a stock solution container according to the present invention is used, is open.

A container according to the present invention will be described below based on the drawings. In the drawings, like constituents are assigned like signs.

As shown in FIG. 1, a beverage dispenser 1, which serves as an example of a liquid dispenser, has a dispenser body 2 that has an opening in its front face, and a door 3 for opening and closing the opening. A plurality of stock solution containers 30, each serving as an example of a container containing a liquid, are accommodated in an accommodating portion 4 within the dispenser body 2.

In this embodiment, eight stock solution containers 30 are accommodated in the accommodating portion 4. A 10-times concentrated stock solution, which serves as an example of a liquid and is diluted with a diluent to constitute, for example, a sugar-free beverage such as tea, a 6-times concentrated stock solution, which serves as an example of a liquid and is diluted with a diluent to constitute a sugared beverage such as cider, and the like are contained in the stock solution containers 30. The beverage dispenser 1 includes a cooling mechanism for cooling the inside of the accommodating portion 4. The stock solution containers 30 accommodated in the accommodating portion 4 are cooled at a predetermined temperature by the cooling mechanism.

An operation unit (not shown), which includes selection buttons for selecting a desired beverage from a menu that includes sugar-free beverages such as tea, sugared beverages such as cider, and the like, is arranged on a surface of the door 3.

Stock solution ejection mechanisms 5, each of which serves as an example of a liquid ejection mechanism and is for ejecting the concentrated stock solutions contained in the stock solution containers 30, are arranged below the accommodating portion 4.

A cup rest 6, which is a tray on which a cup C is to be placed, is arranged below the stock solution ejection mechanisms 5. Note that the vessel into which a beverage is to be ejected is not limited to the cup C. For example, a vessel such as a glass or a pitcher into which a beverage can be ejected is used.

A drinking water supply mechanism 7, which introduces water from the outside to generate drinking water, and supplies the drinking water as a diluent to the dispenser body 2, is connected to the dispenser body 2 via a drinking water supply line 8.

A gas cylinder 9 containing carbon dioxide gas is connected to the dispenser body 2 via a gas supply line 10.

Figure 2:
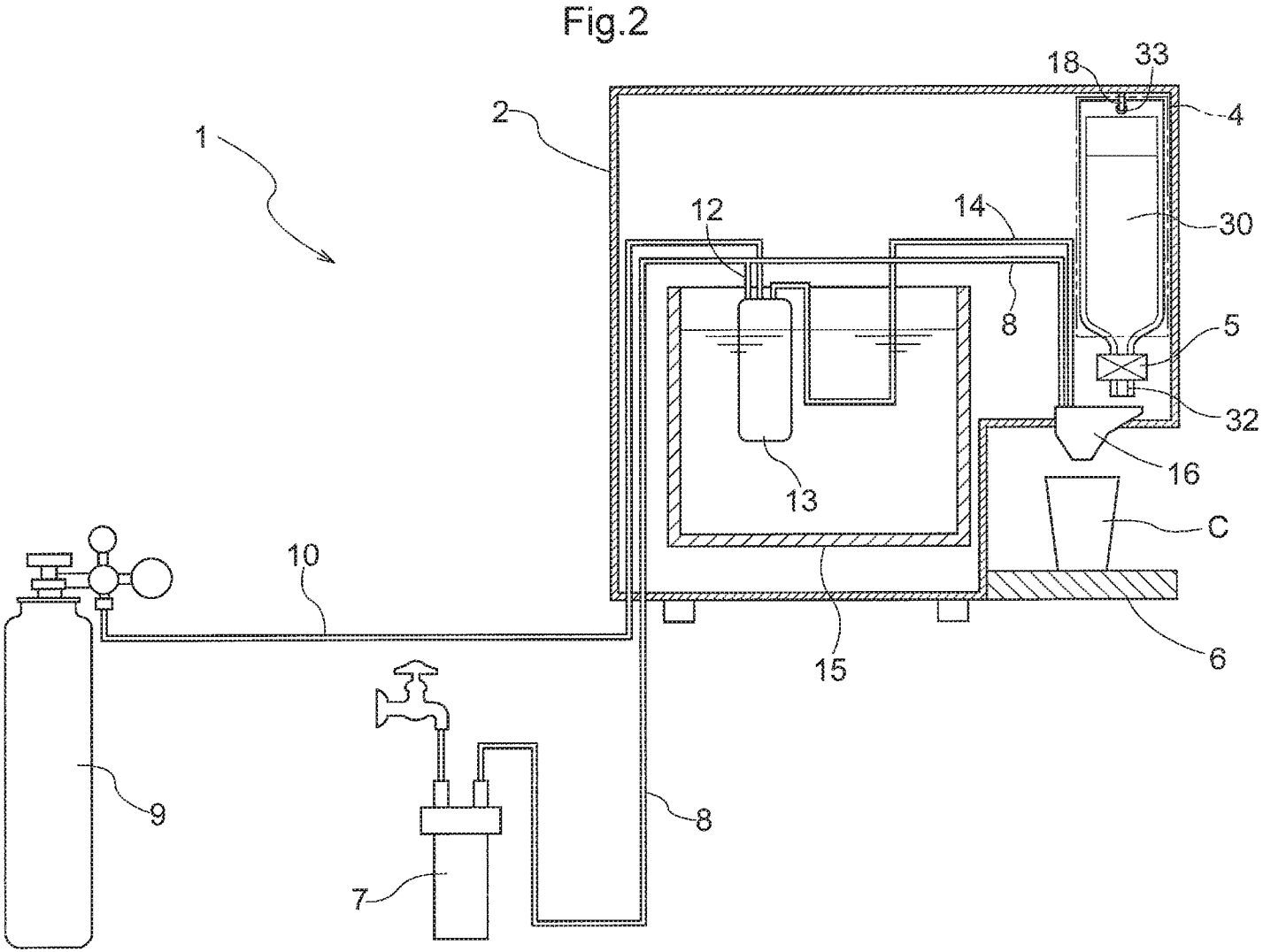
FIG. 2 is a diagram illustrating a structure of the beverage dispenser in which the stock solution container according to the present invention is used.

FIG. 2 shows a structure of the beverage dispenser 1.

The dispenser body 2 of the beverage dispenser 1 includes the stock solution ejection mechanisms 5, each of which is for opening and closing an ejecting portion 32 for a corresponding one of the stock solution containers 30 that are suspended on hooks 18, each serving as a suspending portion provided within the accommodating portion 4, and ejecting a concentrated stock solution of a non-carbonated beverage or a concentrated stock solution of a carbonated beverage in accordance with the selected beverage, a drinking water supply line 8 for supplying drinking water, which is generated using tap water via a drinking water supply mechanism 7 and serves as a diluent for diluting a concentrated stock solution of a non-carbonated beverage, a carbonator, which serves as a carbonated water supply mechanism 13 for mixing carbon dioxide gas in the gas cylinder 9 that is supplied from a gas supply line 10 with drinking water supplied from a branch line 12, which branches from the drinking water supply line 8, and generating carbonated water to serve as a diluent to dilute a concentrated stock solution of a carbonated beverage, a carbonated water supply line 14 for supplying the carbonated water, and so on. The carbonated water supply mechanism 13 and the carbonated water supply line 14 are partially arranged in a cooling bath 15 that is arranged in the dispenser body 2. Terminals of the ejecting portions 32 of each stock solution container 30, the drinking water supply line 8, and the carbonated water supply line 14 are open toward a beverage discharge port 16. The beverage discharge port 16 may not necessarily be provided.

Figure 3A:
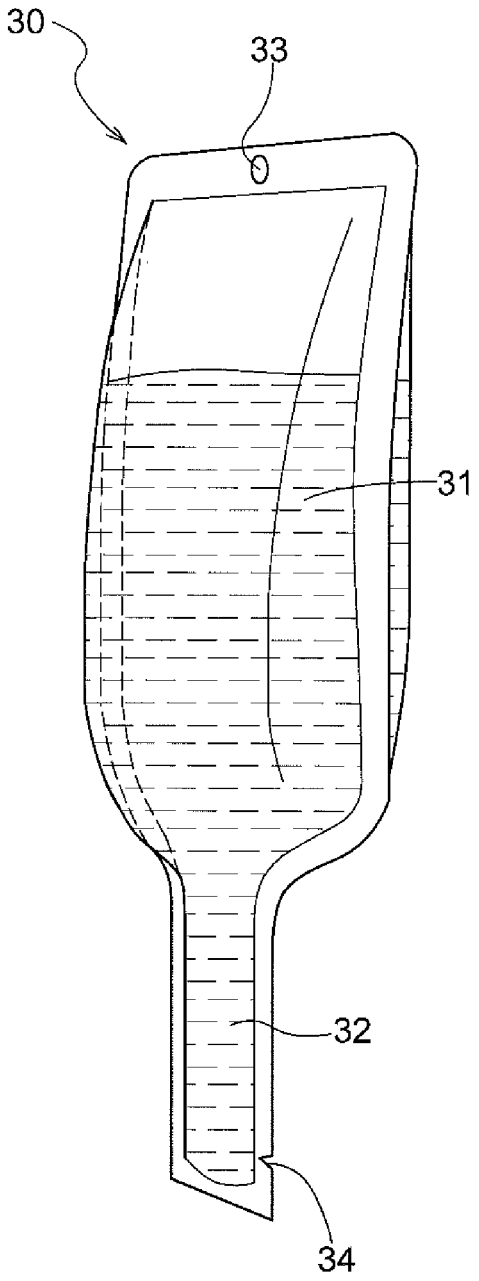
FIGS. 3(A) and 3(B) illustrate a stock solution container according to the present invention that is to be accommodated in the beverage dispenser.
Figure 3B:
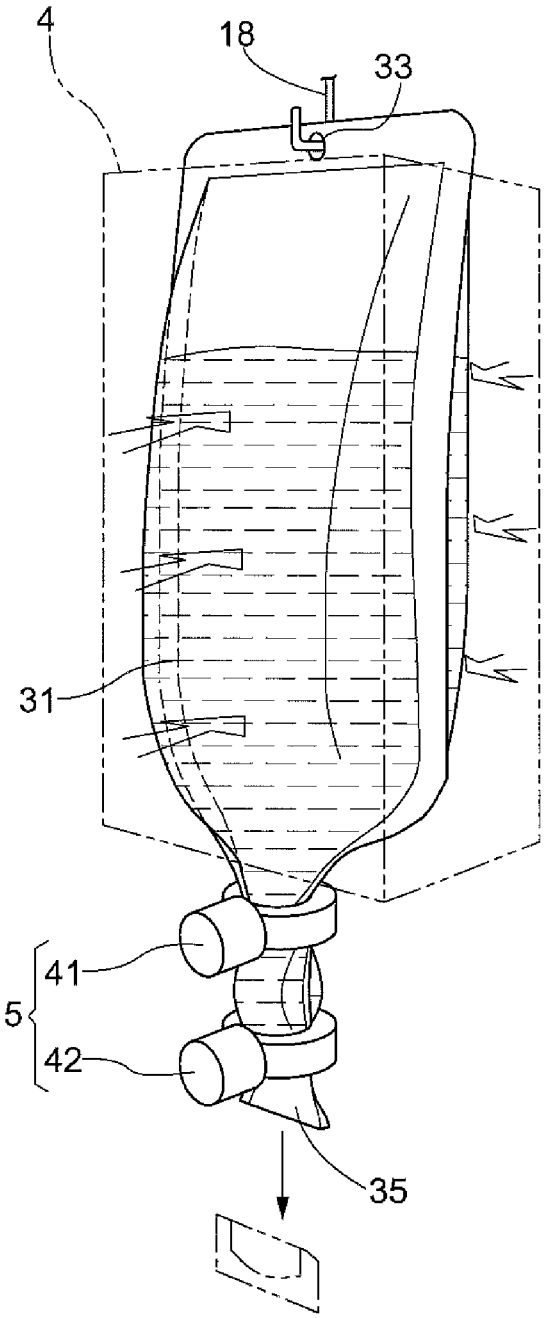

FIG. 3(*a*) is a diagram showing the stock solution container 30.

The stock solution container 30 includes a bag-shaped containing portion 31 that contains a concentrated stock solution, and the ejecting portion 32, which is for ejecting the concentrated stock solution to the outside and protrudes downward from the bag-shaped containing portion 31. A suspension hole 33 for hanging the stock solution container 30 on the hook 18, which is provided in the beverage dispenser 1, is provided in a peripheral portion of the containing portion 31 of the stock solution container 30 on the side opposite to the ejecting portion 32. A cutout portion 34, which is capable of being used to form the ejection port 35, is provided in a peripheral portion of the ejecting portion 32 near the leading end thereof.

The stock solution container 30 is formed by laying two flexible resin sheets over each other and heat-sealing a peripheral portion thereof in an inseparable manner.

For example, specifically, the stock solution container 30 can be formed in a liquid-tight manner by laying the two sheets over each other, heat-sealing the peripheral portion of the containing portion 31, except for the ejecting portion 32, to form a bag shape, injecting a concentrated stock solution into the containing portion 31, and then heat-sealing a peripheral portion of the ejecting portion 32. However, the sealing method is not limited thereto. For example, refilling can be performed from the peripheral portion of the containing portion 31, rather than from the ejecting portion 32. It is preferable that the stock solution container 30 is manufactured in an inert gas atmosphere. Thereafter, the suspension hole 33 is formed in the peripheral portion.

The sheets are made of a synthetic resin, at least in their faces that are on the inner side of the stock solution container 30. The sheets are each constituted by single-layer or multi-layer synthetic resin whose main component is, for example, polyolefin resin, polyamide resin, polyester resin, (meth)acrylic resin, vinyl chloride resin, vinylidene chloride resin, polyethersulfone, an ethylene-vinyl alcohol copolymer, or the like.

Polyolefin resin is preferable due to its excellent transparency, flexibility, and sanitary properties, and is low-cost.

Examples of polyolefin resin include polyethylene resins such as high-density polyethylene, medium-density polyethylene, high-pressure, low-density polyethylene, linear low-density polyethylene, and an ethylene-vinyl acetate copolymer, olefin elastomers such as an ethylene-α-olefine random copolymer, polypropylene resins such as polypropylene, an ethylene-propylene random copolymer, and an α-olefin propylene random copolymer, cyclic polyolefin resin, and so on. These resins may be mixed in order to increase performance. They may also be partially cross-linked to improve heat-resistance.

The sheets are not limited to single-layer sheets made of polyolefin resin, and may also be multi-layer sheets with respective layers made of different polyolefin resins or the like. In the case of multi-layer sheets, a configuration in which an adhesive or the like is not used is preferable.

The two sheets may be identical, or may be different. However, it is preferable that at least opposing faces of the sheets are made of the same type of resin in terms of ease of heat-sealing. It is also preferable that the sheets are identical sheets, and are, furthermore, sheets that are made of a single type of synthetic resin, in terms of ease of manufacturing and disposal.

By forming the stock solution container 30 using a synthetic resin with excellent transparency, it is possible to easily identify the contained stock solution, as well as to visually check the amount of remaining concentrated stock solution and easily recognize a color change, turbidity, or the like. Marks that indicate the type of contained concentrated stock solution, the amount of remaining concentrated stock solution, and the expiration date may be displayed on a surface of the containing portion 31 of the stock solution container 30.

The thickness of each sheet preferably is about 30 to 600 μm, or more preferably is particularly about 100 to 400 μm.

The stock solution container 30 has a thin sheet shape after all of the concentrated stock solution has been ejected. Accordingly, the stock solution container 30 can be compactly folded for disposal.

The stock solution container 30, which is configured as described above, is suspended with the ejecting portion 32 positioned below by hanging the stock solution container 30 on the hook 18, which is provided within the accommodating portion 4 of the dispenser body 2, at the suspension hole 33, as shown in FIG. 3(*b*). By horizontally or obliquely cutting off, in this state, a lower end of the ejecting portion 32 from a cutout portion 34, which is formed at the lower end as shown in FIG. 3(*a*), with fingers, scissors, or the like that have been sterilized using an alcohol spray, an open end is formed as shown in FIG. 3(*b*), and this open end constitutes an ejection port 35.

Next, the stock solution ejection mechanism 5 will be described.

A pinch valve 41 is arranged on the ejecting portion 32 on the containing portion 31 side.

A pinch valve 42 is arranged on the ejecting portion 32 on the ejection port 35 side.

The pinch valves 41 and 42 are configured to control flow of the concentrated stock solution from the containing portion 31 side toward the ejection port 35 side by causing electromagnetically-driven plungers to come into contact with, or not come into contact with the ejecting portion 32 from two opposite sides, for example.

The pinch valve 41 is a first valve body that is arranged in a flow path from the containing portion 31 to the ejecting portion 32. A mechanism that drives a plunger in this pinch valve 41, which serves as the first valve body, to open and close the pinch valve 41 constitutes a first valve body opening/closing mechanism.

The pinch valve 42 is a second valve body that is arranged in a flow path from the ejecting portion 32 to the ejection port 35. A mechanism that drives a plunger in this pinch valve 42, which serves as the second valve body, to open and close the pinch valve 42 constitutes a second valve body opening/closing mechanism.

The first valve body opening/closing mechanism and the second valve body opening/closing mechanism are individually controlled by an opening/closing control mechanism (not shown) so as to avoid a state where neither the plunger in the pinch valve 41 nor the plunger in the pinch valve 42 clamps the ejecting portion 32 at the same time. The first valve body, the second valve body, the first valve body opening/closing mechanism, the second valve body opening/closing mechanism, and the opening/closing control mechanism constitute the stock solution ejection mechanism 5.

The first valve body, namely the pinch valve 41, or the second valve body, namely the pinch valve 42, being closed refers to a state where the plunger in the pinch valve 41 or the pinch valve 42 clamps the ejecting portion 32, and the concentrated stock solution does not flow through the clamped portion from the containing portion 31 side toward the ejection port 35 side. The first valve body, namely the pinch valve 41, or the second valve body, namely the pinch valve 42, being open refers to a state where the plunger in the pinch valve 41 or the pinch valve 42 does not clamp the ejecting portion 32, and the concentrated stock solution accordingly flows from the containing portion 31 side toward the ejection port 35 side.

It is preferable that a gap between the pinch valve 41 and the pinch valve 42 is set so that, when the pinch valve 41 and the pinch valve 42 are closed, the amount of concentrated stock solution that is retained in the ejecting portion 32 therebetween is a specific amount of concentrated stock solution that is to be ejected at a time. That is to say, the pinch valves 41 and 42 can also function as a concentrated stock solution measuring mechanism.

The accommodating portion 4 for accommodating the stock solution container 30 is constituted by a sealed space of which the periphery is kept airtight with the stock solution container 30 suspended. A pressurizing gas supply mechanism (not shown) for supplying, as pressurizing gas, the carbon dioxide gas in the gas cylinder 9 is connected to this sealed space. It is favorable that the accommodating portion 4 includes a pressure control mechanism for releasing the pressurizing gas supplied by the pressurizing gas supply mechanism.

The containing portion 31 is prompted to deform due to the pressurizing gas supply mechanism setting the inside of the accommodating portion 4 to be in a positive pressure state. The concentrated stock solution contained therein is reliably pressed out toward the ejecting portion 32. The pressurizing gas supply mechanism is a first pressurizing mechanism that is capable of pressurizing the containing portion 31 from the outside.

Figure 4A:
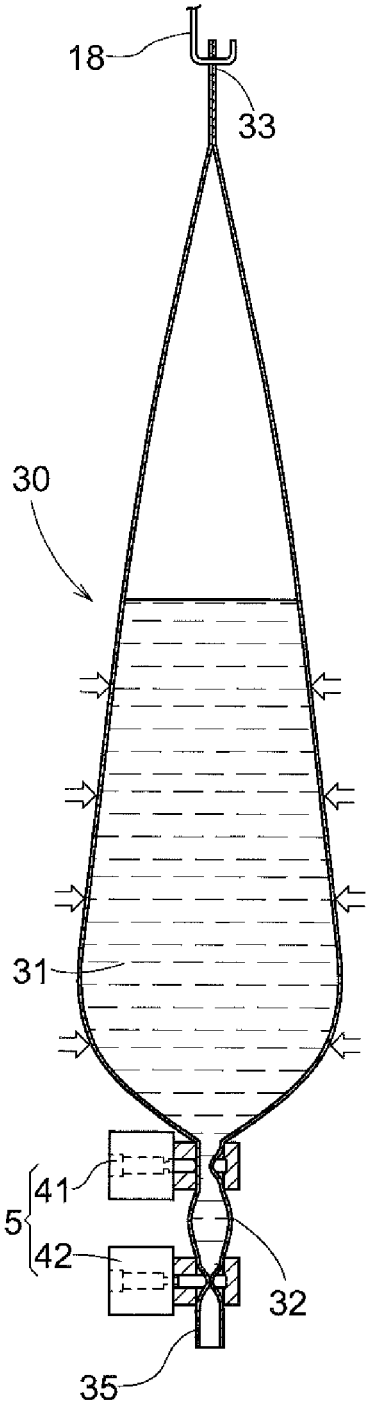
FIGS. 4(A)-4(C) illustrate a stock solution ejection mechanism.
Figure 4B:
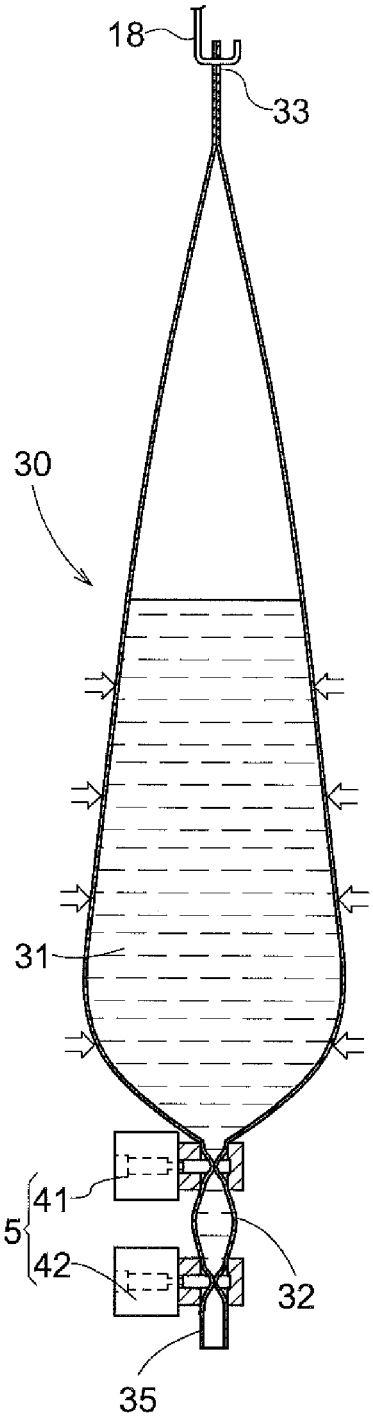
Figure 4C:
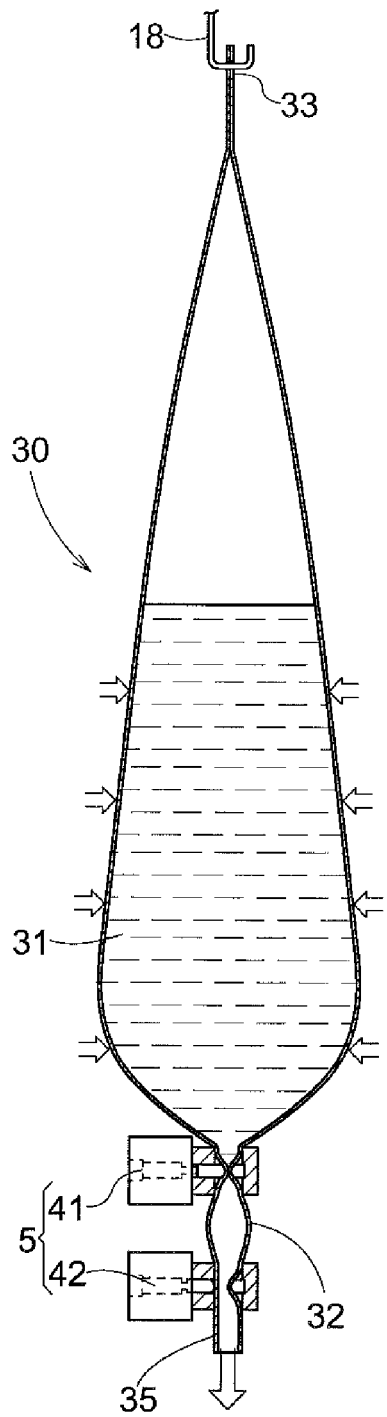

As shown in FIG. 4(*a*), when the inside of the accommodating portion 4 is kept at positive pressure by controlling the pressurizing gas supply mechanism, and the pinch valve 42 is closed and the pinch valve 41 is opened while applying a predetermined pressing force to the stock solution container 30, the concentrated stock solution in the containing portion 31 flows from the containing portion 31 toward the ejecting portion 32 due to the pressing force that is based on the positive pressure, in addition to gravity.

Next, when the pinch valve 41 is closed with the pinch valve 42 already closed as shown in FIG. 4(*b*), the flow of the concentrated stock solution from the containing portion 31 toward the ejecting portion 32 is stopped.

Lastly, when the pinch valve 42 is opened with the pinch valve 41 closed as shown in FIG. 4(*c*), the concentrated stock solution in the ejecting portion 32 is ejected from the ejection port 35 to the outside.

Thus, as a result of the stock solution ejection mechanism 5 and the gas supply mechanism being appropriately controlled, a specific amount of concentrated stock solution is appropriately ejected from the stock solution container 30.

In addition, the amount of concentrated stock solution to be ejected from the ejection port 35 can also be controlled by controlling the pressing force applied by the first pressurizing mechanism in conjunction with the control to open and close the pinch valves 41 and 42. In this case, the first pressurizing mechanism also functions as a measurement mechanism.

Upon a user operating a selection button that corresponds to a desired beverage, the stock solution ejection mechanism 5 that corresponds to the operated selection button is controlled, so that the concentrated stock solution contained in the stock solution container 30 is ejected from the ejection port 35, a diluent that corresponds to the ejected concentrated stock solution, the diluent being either drinking water or carbonated water, is simultaneously supplied from the drinking water supply line 8 or the carbonated water supply line 14, and a beverage adjusted at the beverage discharge port 16 is supplied to the cup C.

The above embodiment has described the case where the first valve body is the pinch valve 41, and the second valve body is the pinch valve 42. However, the configuration of the first valve body, the second valve body, the first valve body opening/closing mechanism, the second valve body opening/closing mechanism, and the opening/closing control mechanisms is not limited thereto.

Figure 5A:
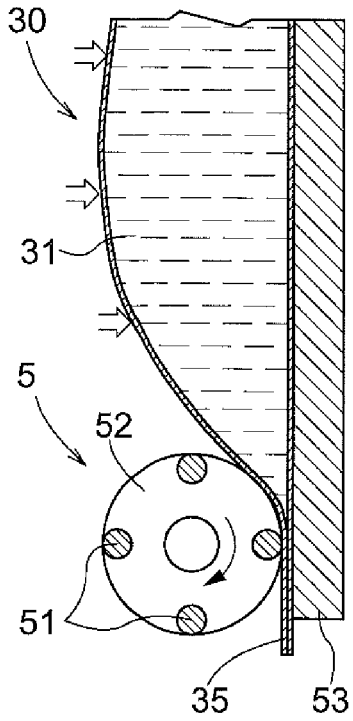
FIGS. 5(A)-5(C) illustrate the stock solution ejection mechanism according to another embodiment.
Figure 5B:
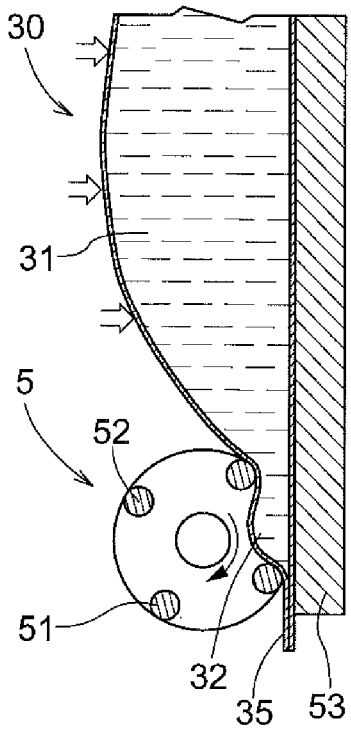
Figure 5C:
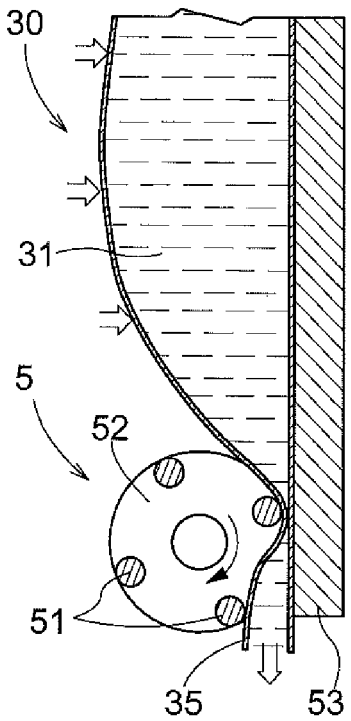

The stock solution ejection mechanism 5 may be configured to include a tube pump mechanism as shown in FIGS. 5(*a*) to 5(*c*), for example.

This tube pump mechanism includes a rotor 52 having a plurality of rollers 51 that are arranged at equal intervals in the circumferential direction and are rotatably held, and a pressure-receiving wall 53 that clamps the ejecting portion 32 between the pressure-receiving wall 53 and the rotor 52.

By arranging the ejecting portion 32 between the rollers 51 and the pressure-receiving wall 53 and rotating the rotor 52 in a fixed direction, the plurality of rollers 51 sequentially pass the ejecting portion 32 therethrough against the pressure-receiving wall 53, passing the ejecting portion 32 between the rollers 51 and the pressure-receiving wall 53 while moving. As a result, the concentrated stock solution is ejected from the ejection port 35 by an amount that corresponds to a gap between two adjoining rollers 51, that is, a specific amount at a time.

Note that the tube pump mechanism can continuously eject the concentrated stock solution by continuously rotating the rotor 52 while an operation button is being operated.

The rollers 51 and the pressure-receiving wall 53 that come into contact with the ejecting portion 32 in a state where the rotor 52 is rotating are the first valve body arranged in a flow path from the containing portion 31 to the ejecting portion 32 or the second valve body arranged in a flow path from the ejecting portion 32 to the ejection port 35. The rotor 52 for moving the first valve body and the second valve body constitutes the first valve body opening/closing mechanism and the second valve body opening/closing mechanism. An actuator, for example, for rotating the rotor 52 constitutes the opening/closing control mechanism.

The rollers 51 are arranged at predetermined positions in the circumferential direction of the rotor 52 so as to avoid a state where the ejecting portion 32 is not clamped between any of the rollers 51 and the pressure-receiving wall 53.

The first valve body, the second valve body, the first valve body opening/closing mechanism, the second valve body opening/closing mechanism, and the opening/closing control mechanism constitute the stock solution ejection mechanism 5.

The first valve body or the second valve body, namely any one of the rollers 51 and the pressure-receiving wall 53, being closed refers to a state where the roller 51 and the pressure-receiving wall 53 clamp the ejecting portion 32, and the concentrated stock solution does not flow through the clamped portion from the containing portion 31 side toward the ejection port 35 side. The first valve body or the second valve body, namely any of the rollers 51 and the pressure-receiving wall 53 being open refers to a state where the roller 51 and the pressure-receiving wall 53 do not clamp the ejecting portion 32, and the concentrated stock solution accordingly flows from the containing portion 31 side toward the ejection port 35 side.

Figure 6A:
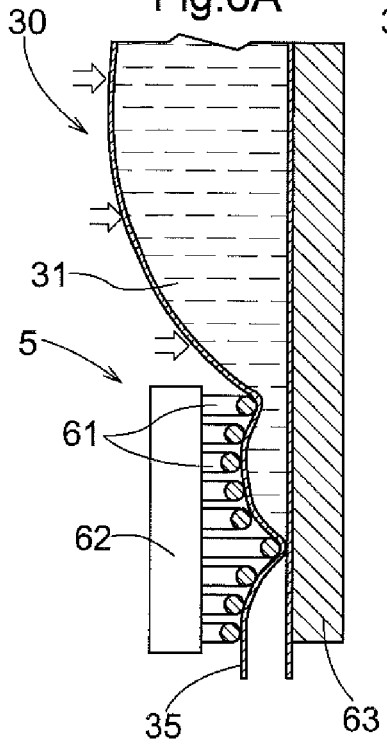
FIGS. 6(A)-6(C) illustrate the stock solution ejection mechanism according to another embodiment.
Figure 6B:
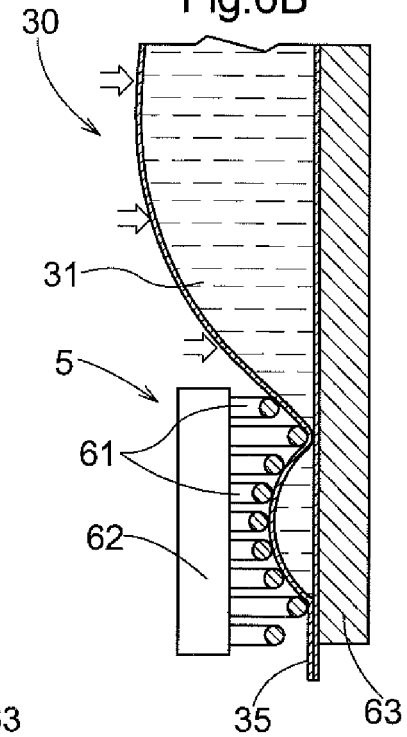
Figure 6C:
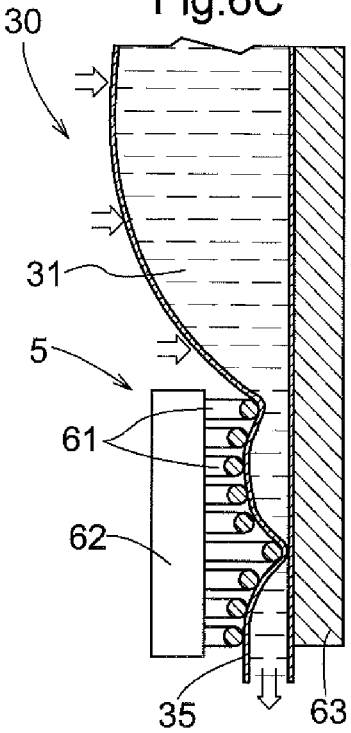

The stock solution ejection mechanism 5 may be configured to include a finger pump mechanism as shown in FIGS. 6(*a*) to 6(*c*), for example.

This finger pump mechanism includes fingers 61 that are arranged at equal intervals in the direction in which the ejecting portion 32 is arranged, a pressure-receiving wall 63 for clamping the ejecting portion 32 between the pressure-receiving wall 63 and the fingers 61, and a cam mechanism 62 for sequentially moving the fingers 61 back and forth.

The ejecting portion 32 is arranged between the fingers 61 and the pressure-receiving wall 63, and the ejecting portion 32 is passed therebetween due to peristaltic movement generated by sequentially moving the fingers 61 back and forth. As a result, the concentrated stock solution is ejected from the ejection port 35 by an amount that corresponds to a single phase of the fingers 61, i.e. a predetermined amount at a time.

Note that the finger pump mechanism can continuously eject the concentrated stock solution by continuously causing the fingers 61 to perform peristaltic movement while the operation button is being operated.

Among the fingers 61, those that are arranged on the containing portion 31 side of the ejecting portion 32 constitute a first valve body arranged in a flow path from the containing portion 31 to the ejecting portion 32. Among the fingers 61, those that are arranged on the ejection port 35 side of the ejecting portion 32 constitute a second valve body arranged in a flow path from the ejecting portion 32 to the ejection port 35. The cam mechanism 62 for moving the first valve body and the second valve body back and forth constitutes a first valve body opening/closing mechanism and a second valve body opening/closing mechanism. An actuator, for example, for driving the cam mechanism 62 constitutes an opening/closing control mechanism.

All of the fingers 61 are moved back and forth by the cam mechanism 62 so as to avoid a state where the ejecting portion 32 is not clamped between any of the fingers 61 and the pressure-receiving wall 63.

The first valve body, the second valve body, the first valve body opening/closing mechanism, the second valve body opening/closing mechanism, and the opening/closing control mechanism constitute the stock solution ejection mechanism 5.

The first valve body or the second valve body, namely any of the fingers 61 and the pressure-receiving wall 63 being closed refers to a state where the fingers 61 and the pressure-receiving wall 63 clamp the ejecting portion 32, and the concentrated stock solution does not flow through the clamped portion from the containing portion 31 side toward the ejection port 35 side. The first valve body or the second valve body, namely any of the fingers 61 and the pressure-receiving wall 63 being open refers to a state where a finger 61 and the pressure-receiving wall 63 do not clamp the ejecting portion 32, and the concentrated stock solution accordingly flows from the containing portion 31 side toward the ejection port 35 side.

Although not shown in the diagrams, the stock solution ejection mechanism 5 may be configured to include an upper clamping member that is arranged on the ejecting portion 32 on the containing portion 31 side, and a lower clamping member that is arranged on the ejecting portion 32 on the ejection port 35 side.

These clamping members are configured to be driven by, for example, an actuator, prevent the concentrated stock solution from flowing from the containing portion 31 side toward the ejection port 35 side by clamping the ejecting portion 32, and allow the concentrated stock solution to flow from the containing portion 31 side toward the ejection port 35 side by not clamping the ejecting portion 32.

The upper clamping member is a first valve body arranged in a flow path from the containing portion 31 to the ejecting portion 32. The lower clamping member is a second valve body arranged in a flow path from the ejecting portion 32 to the ejection port 35. The actuator for opening and closing the first valve and the second valve body constitutes a first valve body opening/closing mechanism and a second valve body opening/closing mechanism. The first valve body opening/closing mechanism and the second valve body opening/closing mechanism are controlled by an opening/closing control mechanism.

The opening/closing control mechanism individually controls the first valve body opening/closing mechanism and the second valve body opening/closing mechanism so as to avoid a state where neither the upper clamping member nor the lower clamping member clamps the ejecting portion 32 at the same time.

The first valve body, the second valve body, the first valve body opening/closing mechanism, the second valve body opening/closing mechanism, and the opening/closing control mechanism constitute the stock solution ejection mechanism 5.

The first valve body or the second valve body, namely the upper clamping member or the lower clamping member being closed refers to a state where the upper clamping member or the lower clamping member clamps the ejecting portion 32, and the concentrated stock solution accordingly does not flow through the clamped portion from the containing portion 31 side toward the ejection port 35 side. The first valve body or the second valve body, namely the upper clamping member or the lower clamping member being open refers to a state where the upper clamping member or the lower clamping member does not hold the ejecting portion 32, and the concentrated stock solution accordingly flows from the containing portion 31 side toward the ejection port 35 side.

Furthermore, although not shown in the diagrams, the stock solution ejection mechanism 5 may be configured to include an upper folding mechanism that is capable of folding the ejecting portion 32 on the containing portion 31 side, and a lower folding mechanism that is capable of folding the ejecting portion 32 on the ejection port 35 side.

These folding mechanisms are configured to be driven by, for example, an actuator, prevent the concentrated stock solution from flowing from the containing portion 31 side toward the ejection port 35 side by folding the ejecting portion 32, and cause the concentrated stock solution to flow from the containing portion 31 side toward the ejection port 35 side by not folding the ejecting portion 32.

The upper folding mechanism is a first valve body arranged in a flow path from the containing portion 31 to the ejecting portion 32. The lower folding mechanism is a second valve body arranged in a flow path from the ejecting portion 32 to the ejection port 35. The actuator for opening and closing the first valve body and the second valve body constitutes a first valve body opening/closing mechanism and a second valve body opening/closing mechanism. The first valve body opening/closing mechanism and the second valve body opening/closing mechanism are controlled by an opening/closing control mechanism.

The opening/closing control mechanism individually controls the first valve body opening/closing mechanism and the second valve body opening/closing mechanism so as to avoid a state where neither the upper folding mechanism nor the lower folding mechanism folds the ejecting portion 32 at the same time.

The first valve body, the second valve body, the first valve body opening/closing mechanism, the second valve body opening/closing mechanism, and the opening/closing control mechanism constitute the stock solution ejection mechanism 5.

The first valve body or the second valve body, namely the upper folding mechanism or the lower folding mechanism being closed refers to a state where the upper folding mechanism or the lower folding mechanism folds the ejecting portion 32, and the concentrated stock solution does not flow through the folded portion from the containing portion 31 side toward the ejection port 35 side. The first valve body or the second valve body, namely the upper folding mechanism or the lower folding mechanism being open refers to a state where the upper folding mechanism or the lower folding mechanism does not fold the ejecting portion 32, and the concentrated stock solution accordingly flows from the containing portion 31 side toward the ejection port 35 side.

The above embodiment has described a configuration in which the accommodating portion 4 for accommodating the stock solution container 30 is configured as the first pressurizing mechanism by a sealed space, carbon dioxide gas in the gas cylinder 9 is supplied as pressurizing gas by the pressurizing gas supply mechanism that is connected to this sealed space, and the concentrated stock solution contained in the containing portion 31 is pushed out toward the ejecting portion 32 by setting the inside of the accommodating portion 4 to be in a positive pressure state. However, the invention is not limited thereto.

The first pressurizing mechanism may be configured to press the stock solution container 30 by supplying carbon dioxide gas in the gas cylinder 9 to an air bag that is provided adjacent to the stock solution container 30 in the accommodating portion 4 to inflate the air bag. Otherwise, the first pressurizing mechanism may be constituted by a water bag that expands when supplied with cooling water, instead of the air bag. In this case, the concentrated stock solution contained in the stock solution container 30 can also be cooled by the cooling water supplied to the water bag. The amount of concentrated stock solution to be ejected from the ejection port 35 can be controlled by controlling the degree of pressing by the air bag or the water bag.

A configuration may be employed in which the first pressurizing mechanism is constituted by a pressurizing member that is provided in the accommodating portion 4 adjacent to the stock solution container 30, and the stock solution container 30 is pressed against by moving this pressurizing member toward the stock solution container 30. Note that the pressurizing member may be configured to be moved mechanically or hydraulically by an actuator, or may be configured to be moved using the elastic force of an elastic body such as a spring or a sponge.

Otherwise, the pressurizing member may be configured to move under its own weight. In this case, the stock solution container 30 is placed in the accommodating portion 4 without being suspended, and the pressurizing member need only be placed on the stock solution container 30 placed in the accommodating portion 4.

The first pressurizing mechanism may be configured to squeeze the concentrated stock solution by twisting the containing portion 31.

A constituent similar to the above-described first pressurizing mechanism may be provided as a second pressurizing mechanism so as to be able to pressurize, from the outside, a portion of the ejecting portion 32 between the first valve body and the second valve body. The rollers 51 shown in FIGS. 5(*a*) to 5(*c*) and the fingers 61 shown in FIGS. 6(*a*) to 6(*c*) also function as the second pressurizing mechanism. The second pressurizing mechanism may also be constituted by a pair of rollers that are arranged on respective sides of the ejecting portion 32. The concentrated stock solution can be ejected by clamping the ejecting portion 32 using the pair of rollers and passing the ejecting portion 32 therethrough downward from below. The second pressurizing mechanism can more reliably eject the concentrated stock solution in the portion between the first valve body and the second valve body by being operated when in a state where the first valve body is closed and the second valve body is open.

Note that the beverage dispenser 1 may not include the above-described first pressurizing mechanism and second pressurizing mechanism. In this case, a configuration is employed in which the concentrated stock solution is ejected from the ejection port 35 of the stock solution container 30 due to the weight of the concentrated stock solution itself. A flexible tube body that spans at least the first valve body and the second valve body may be inserted into the ejecting portion 32. When the flexible tube body is closed together with the ejecting portion 32 by the first valve body and the second valve body, and is thereafter opened, the ejecting portion 32 is opened due to the restoring force of the flexible tube body, without the first pressurizing mechanism forcibly sending the concentrated stock solution in the containing portion 31 to the ejecting portion 32.

The stock solution ejection mechanism 5 may be configured to eject the concentrated stock solution from the ejection port 35 using an opening/closing mechanism for forcibly opening and closing the ejecting portion 32 of the stock solution container 30.

Figure 7A:
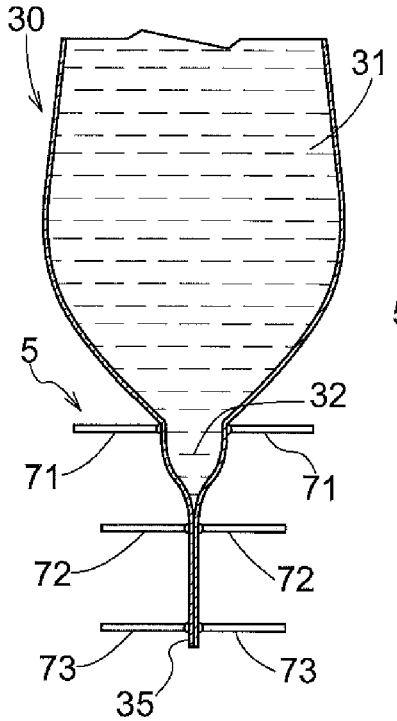
FIGS. 7(A)-7(C) illustrate the stock solution ejection mechanism according to another embodiment.
Figure 7B:
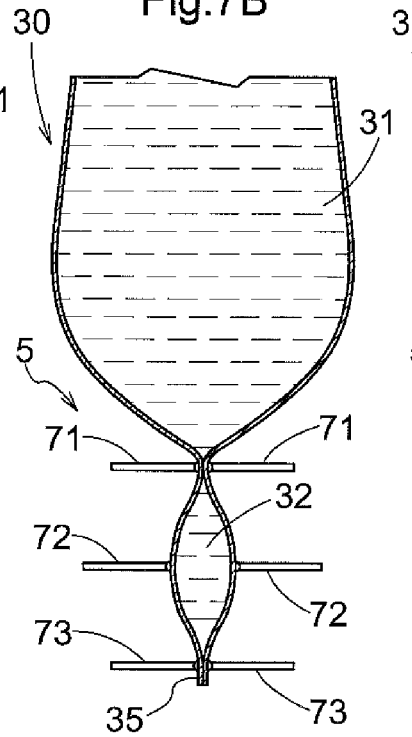
Figure 7C:
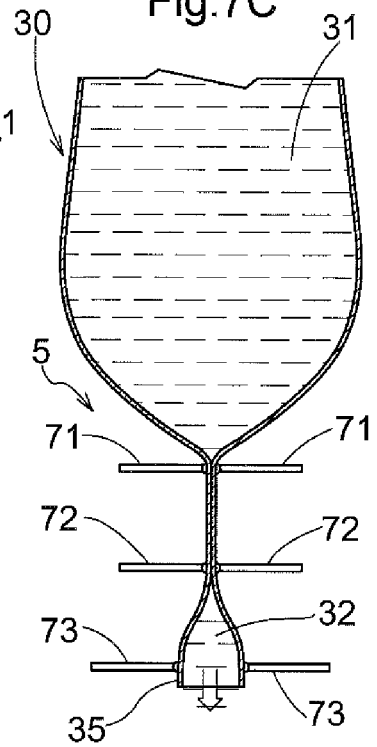

As shown in FIGS. 7(*a*) to 7(*c*), for example, the opening/closing mechanism includes pairs of pushing/pulling members 71, 72, and 73 that are additionally joined to respective faces of the ejecting portion 32 by means of attachment, adhesion, pressure-bonding, or the like, or pairs of pushing/pulling members 71, 72, and 73 that are integrally installed, in a projecting manner, on the respective faces of the ejecting portion 32.

Specifically, the pushing/pulling members 71 are arranged on the containing portion 31 side of the ejecting portion 32.

The pushing/pulling members 73 are arranged on the ejection port 35 side of the ejecting portion 32.

The pushing/pulling members 72 are arranged between the pushing/pulling members 71 and the pushing/pulling members 73.

For example, the pushing/pulling members 71, 72, and 73 are configured to forcibly open and close the ejecting portion 32 by pushing and pulling the ejecting portion 32 using an actuator, and control the flow of the concentrated stock solution from the containing portion 31 side toward the ejection port 35 side.

The pushing/pulling members 71 constitute a first valve body arranged in a flow path from the containing portion 31 to the ejecting portion 32. The actuator for pushing and pulling the pushing/pulling members 71 that serve as the first valve body constitutes a first valve body opening/closing mechanism.

The pushing/pulling members 73 constitute a second valve body that is arranged in a flow path from the ejecting portion 32 to the ejection port 35. The actuator for pushing and pulling the pushing/pulling members 73 that serve as the second valve body constitutes a second valve body opening/closing mechanism.

The pushing/pulling members 72 are a third valve body that is arranged between the first valve body and the second valve body. The actuator for pushing and pulling the pushing/pulling members 72 that serve as the third valve body constitutes a third valve body opening/closing mechanism.

The first valve body opening/closing mechanism to the third valve body opening/closing mechanism are individually controlled by an opening/closing control mechanism (not shown) so as to avoid a state where all of the pushing/pulling members 71 to 73 simultaneously open the ejecting portion 32. The first to third valve bodies, the first to third valve body opening/closing mechanisms, and the opening/closing control mechanism constitute the stock solution ejection mechanism 5.

The first valve body, namely the pushing/pulling members 71, the second valve body, namely the pushing/pulling members 73, or the third valve body, namely the pushing/pulling members 72 being closed refers to a state where the pushing/pulling members 71, the pushing/pulling members 73, or the pushing/pulling members 72 closes the ejecting portion 32, and the concentrated stock solution accordingly does not flow through the closed portion from the containing portion 31 side toward the ejection port 35 side. The first valve body, namely the pushing/pulling members 71, the second valve body, namely the pushing/pulling members 73, or the third valve body, namely the pushing/pulling members 72 being open refers to a state where the pushing/pulling members 71, the pushing/pulling members 73, or the pushing/pulling members 72 opens the ejecting portion 32, and the concentrated stock solution accordingly flows from the containing portion 31 side toward the ejection port 35 side.

It is preferable that the gap between the pushing/pulling members 71 and the pushing/pulling members 73 is set so that, when the pair of pushing/pulling members 72 are pulled to open a portion of the ejecting portion 32 at which the pushing/pulling members 72 are arranged in a state where the pairs of pushing/pulling members 71 and 73 are pushed to close the ejecting portions 32 on the containing portion 31 side and close the ejection port 35, the amount of concentrated stock solution that is retained in the ejecting portion 32 therebetween is a specific amount of concentrated stock solution that is to be ejected at a time. The pushing/pulling members 71, 72, and 73 also function as a concentrated stock solution measuring mechanism.

Even in a state where the containing portion 31 is not pressed by the first pressurizing mechanism as shown in FIG. 7(*a*), when the pushing/pulling members 71 are open with the pushing/pulling members 72 and 73 closed, the concentrated stock solution in the containing portion 31 flows toward the ejecting portion 32 due to a suction force that is generated by opening the pushing/pulling members 71 and exerted toward the ejecting portion 32, in addition to gravity.

Next, when the pushing/pulling members 71 are closed with the pushing/pulling members 73 closed and the pushing/pulling members 72 open as shown in FIG. 7(*b*), the flow of the concentrated stock solution from the containing portion 31 toward the ejecting portion 32 is stopped.

Lastly, when the pushing/pulling members 73 are open with the pushing/pulling members 71 closed as shown in FIG. 7(*c*), the concentrated stock solution in the ejecting portion 32 is ejected from the ejection port 35 to the outside. Note that the pushing/pulling members 72 may be closed in this state. At this time, the pushing/pulling members 72 also function as a second pressurizing mechanism. The concentrated stock solution in the portion between the valve body and the second valve body can be more reliably ejected by operating the second pressurizing mechanism with the pushing/pulling members 71, which constitute the first valve body, closed, and with the pushing/pulling members 73, which constitute the second valve body, open.

Thus, as a result of the stock solution ejection mechanism 5 being appropriately controlled, a specific amount of concentrated stock solution is appropriately ejected from the stock solution container 30.

That is to say, although the first valve body and the second valve body are provided in the beverage dispenser 1, the valve bodies themselves for opening and closing the ejecting portion 32 may be provided on the beverage dispenser 1 side, or may be provided on the stock solution container 30 side. Furthermore, the first valve body and the second valve body may be provided on the beverage dispenser 1 side and the stock solution container 30 side, respectively.

In the above-described embodiment, each of the pinch valves 41 and 42, the tube pump mechanism, the finger pump mechanism, and the pushing/pulling members 71, 72, and 73 can also function as a concentrated stock solution measuring mechanism. However, the concentrated stock solution measuring mechanism may have the following configuration.

A measuring mechanism for measuring the concentrated stock solution ejected from the ejection port 35 may be separately provided below the ejection port 35.

For example, the measuring mechanism is a suction mechanism that is attached to the ejection port 35, and suctions and discharges a predetermined amount of concentrated stock solution from the ejection port 35. The predetermined amount of concentrated stock solution can be ejected by controlling the amount thereof to be discharged by the suction mechanism. Otherwise, the concentrated stock solution may be measured by a load cell that is incorporated in the cup rest 6 and detects the weight of the concentrated stock solution that has been ejected into the cup C. Ejection of the concentrated stock solution may be controlled to stop when it is detected that the specific amount of concentrated stock solution has been ejected into the cup C.

In the above embodiment, the stock solution container 30 is formed by laying two flexible resin sheets over each other and heat-sealing peripheral portions thereof in an inseparable manner. However, the invention is not limited thereto.

Figure 8:
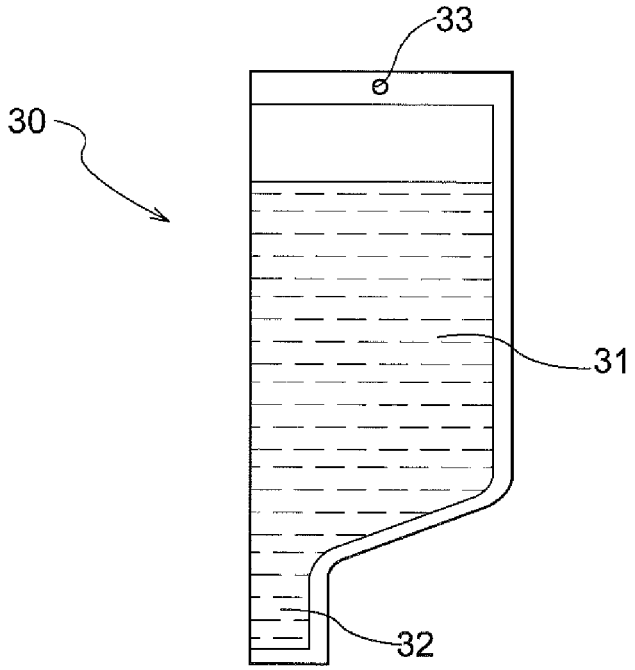
FIG. 8 is a diagram illustrating a stock solution container according to another embodiment.

For example, the stock solution container 30 may be formed with one flexible resin sheet, as shown in FIG. 8. In this case, the stock solution container 30 is obtained by folding one sheet, heat-sealing the peripheral portion of the containing portion 31, except for the ejecting portion 32, to form a bag shape, injecting the concentrated stock solution into the containing portion 31, then heat-sealing the peripheral portion of the ejecting portion 32 to make the ejecting portion 32 liquid-tight, and forming the suspension hole 33. Since the stock solution container 30 is made from one sheet, the number of portions to be heat-sealed is smaller and a lower cost is required than in the case of making the stock solution container 30 from a plurality of sheets.

Figure 9:
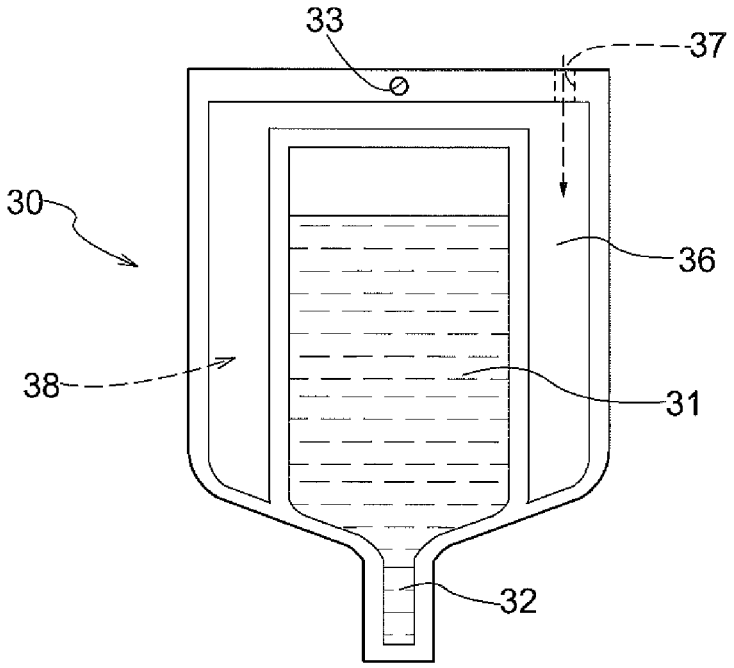
FIG. 9 is a diagram illustrating a stock solution container according to another embodiment.

Also, as shown in FIG. 9, the stock solution container 30 may be configured to include an outer cover portion 36 for further covering the containing portion 31. The stock solution container 30 is a double structure, and has an injecting portion 37 for pressurizing gas in the outer cover portion 36. Pressurizing gas is injected from the injecting portion 37 into a space 38 between the containing portion 31 and the outer cover portion 36, and the inside of the space 38 is set to be in a positive pressure state. Thus, the concentrated stock solution contained in the containing portion 31 can be reliably pushed out to the ejecting portion 32. In this case, the outer cover portion 36 serves as a first pressurizing mechanism that is capable of pressurizing the containing portion 31 from the outside. This pressurizing gas may be the carbon dioxide gas in the gas cylinder 9. Note that the pressurizing gas supplied by the pressurizing gas supply mechanism is not limited to carbon dioxide gas in the gas cylinder 9. That is to say, the pressurizing gas supply mechanism may be constituted by a fan, a blower, or a piston. In this case, gas such as air is compressed to be supplied as the pressurizing gas.

In this case, the stock solution container 30 is obtained by laying four sheets over one another, first heat-sealing the peripheral portion of the containing portion 31 except for the ejecting portion 32, and a peripheral portion of the outer cover portion 36 to form a bag shape, injecting the concentrated stock solution into the containing portion 31, then heat-sealing the peripheral portion of the ejecting portion 32 to make the ejecting portion 32 liquid-tight, and forming the suspension hole 33.

Figure 10:
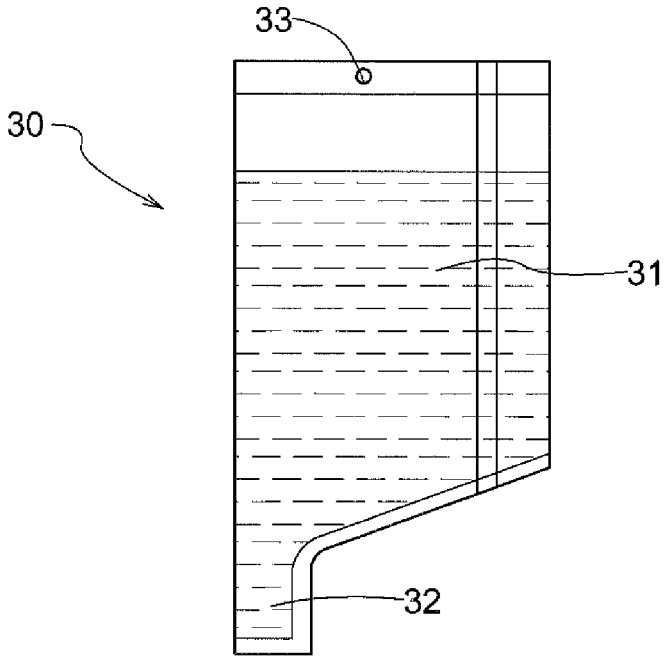
FIG. 10 is a diagram illustrating a stock solution container according to another embodiment.
Figure 11:
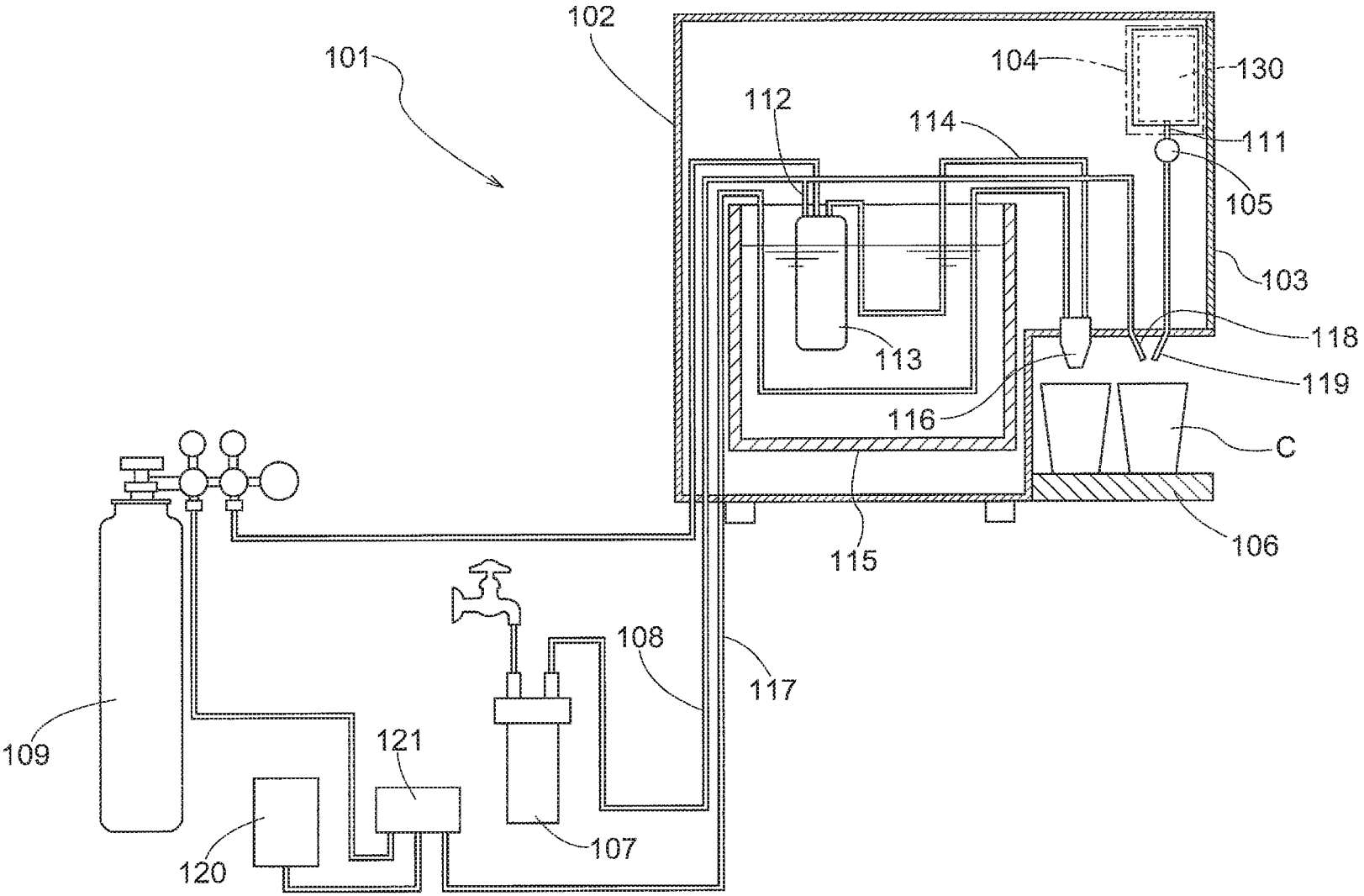
FIG. 11 is a diagram illustrating a structure of a conventional beverage dispenser.

Also, as shown in FIG. 10, the stock solution container 30 may be formed with one flexible resin sheet. In this case, the stock solution container 30 is obtained by rolling one sheet, heat-sealing opposing ends thereof to form a tubular body, thereafter heat-sealing one opening of the tubular body that constitutes the peripheral portion of the containing portion 31, except for the ejecting portion 32, to form a bag shape, injecting the concentrated stock solution into the containing portion 31, then heat-sealing the other opening of the tubular body that constitutes the peripheral portion of the ejecting portion 32 to make the ejecting portion 32 liquid-tight, and forming the suspension hole 33.

All of the stock solution containers 30 are suspended with the ejecting portion 32 on the lower side by hanging the stock solution container 30 on the hook 18, which is provided within the accommodating portion 4 of the dispenser body 2, at the suspension hole 33, as shown in FIG. 3(*b*), for example. By horizontally or obliquely removing, in this state, a lower end of the ejecting portion 32 with, for example, fingers, scissors, or the like that has been sterilized using an alcohol spray, an open end is formed, and this open end constitutes the ejection port 35.

Note that any of the stock solution containers 30 may have a configuration in which a leading end of the ejecting portion 32 is formed in a bottle opening shape with the ejection port 35, and a cap, which is a separate body, is threaded to this bottle opening to seal the ejection port 35. Furthermore, a configuration may also be employed in which a relief valve (valve body) is provided that is opened when a predetermined amount of pressure is applied to the ejection port 35.

In this case, the stock solution container 30 is hung, at the suspension hole 33, on the hook 18 provided in the accommodating portion 4 of the dispenser body 2, and is suspended with the ejecting portion 32 on the lower side, and the ejection port 35 appears when the cap is opened.

In the case where the relief valve is provided on the ejection port 35, the beverage dispenser 1 may include any one of the above-described first valve bodies, and the relief valve may function as a second valve body. Note that a second pressurizing mechanism for applying a predetermined amount of pressure that enables the second valve to be opened also functions as a second valve body opening/closing mechanism.

Note that, in the case of any type of the stock solution container 30, an elastic tube having a length at least from the ejection port 35 to the containing portion 31 may be inserted in advance to an inner periphery of the ejecting portion 32, or may be inserted after the stock solution container 30 is open. This configuration is particularly effective when the first pressurizing mechanism or the second pressurizing mechanism is not provided, in terms of stable ejection of the concentrated stock solution from the stock solution container 30.

In place of, or in addition to the aforementioned tube, an elastic tube having a length at least from the ejection port 35 to the containing portion 31 may be attached in advance to an outer periphery of the ejecting portion 32 of the stock solution container 30, or an elastic ring may be attached in advance at an appropriate position between the ejection port 35 and the containing portion 31. The aforementioned tube or ring may be attached after the stock solution container 30 is open.

By thus using an elastic tube or ring in the ejecting portion 32 of the stock solution container 30 and using a member capable of readily expanding or contracting or an elastic member, such as rubber or resin, at least partially in the ejecting portion 32, stable ejection of a fixed amount can be controlled with a simple configuration.

The stock solution container 30 can also include the following constituents. Note that, in the following description, constituents that correspond to the already-described constituents are assigned the same signs.

Figure 12:
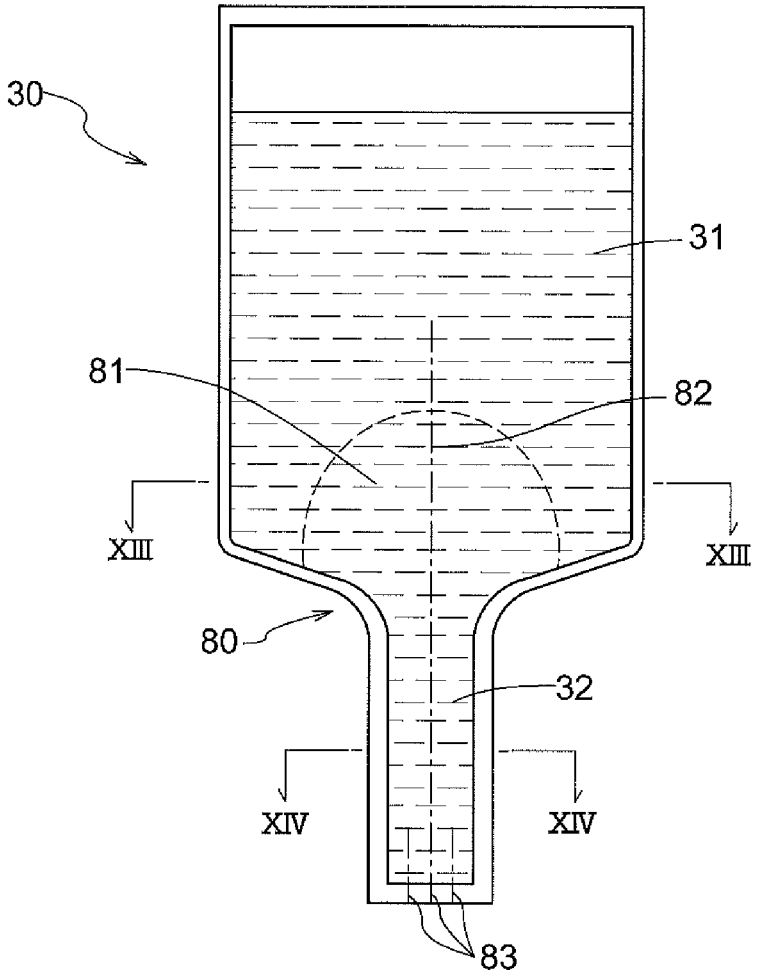
FIG. 12 is a diagram illustrating a stock solution container according to another embodiment.
Figure 13:
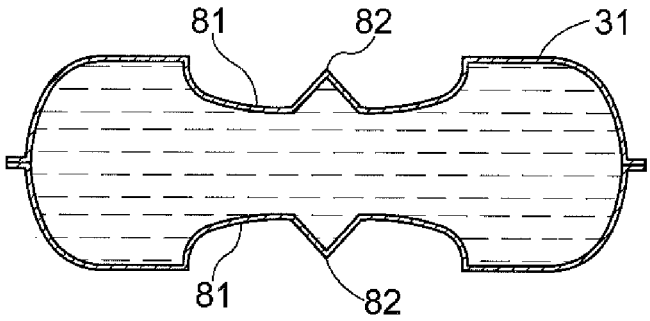
FIG. 13 is a diagram illustrating the stock solution container according to the other embodiment, as viewed in the direction of arrows XIII-XIII in FIG. 12.
Figure 14:
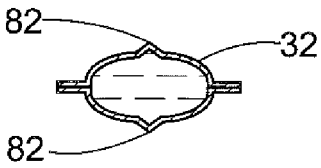
FIG. 14 is a diagram illustrating the stock solution container according to the other embodiment, as viewed in the direction of arrows XIV-XIV in FIG. 12.

FIGS. 12 to 14 show a stock solution container 30 according to another embodiment of the stock solution container 30 shown in FIG. 3(*a*).

The stock solution container 30 includes a transitional portion 80 in the containing portion 31 in a region bordering the ejecting portion 32.

The transitional portion 80 is configured so that its cross-sectional area in a direction perpendicular to the axial direction of the ejecting portion 32 smoothly decreases from the containing portion 31 to the ejecting portion 32.

Since the cross-sectional area of the ejecting portion 32 in the direction perpendicular to the axial direction of the ejecting portion 32 is set to be narrower than that of the containing portion 31, pressure loss tends to increase in the border region between the containing portion 31 and the ejecting portion 32. As a result of providing the transitional portion 80 at such a position, pressure loss can be reduced by smoothly changing the cross-sectional area in the border region between the containing portion 31 and the ejecting portion 32 and the bulging of the stock solution container 30 caused by the concentrated stock solution. In addition, since the shape smoothly changes from the containing portion 31 to the ejecting portion 32 due to the transitional portion 80, the occurrence of wrinkles is suppressed in the border region between the containing portion 31 and the ejecting portion 32. As a result, the concentrated stock solution contained in the containing portion 31 smoothly flows down to the ejecting portion 32.

Furthermore, the containing portion 31 has a recessed portion 81 that expands in a fan shape around the center of the transitional portion 80 as shown in FIG. 12, and is recessed in the thickness direction of the containing portion 31 as shown in FIG. 13.

Furthermore, the containing portion 31 has a protruding portion 82 that vertically divides the transitional portion 80 as shown in FIG. 12, and protrudes outward as viewed in a cross-section in a direction perpendicular to the axial direction of the ejecting portion 32, as shown in FIG. 13. As shown in FIGS. 12 and 14, an upper end of the protruding portion 82 extends past the recessed portion 81, and a lower end thereof reaches the leading end of the ejecting portion 32.

The recessed portion 81 and the protruding portion 82 are obtained by, for example, heat-pressing, in advance, the sheets that constitute the stock solution container 30 to form their shape.

The cross-sectional area of the ejecting portion 32 in the direction perpendicular to the axial direction of the ejecting portion 32 is set to be narrower than that of the containing portion 31. For this reason, pressure loss tends to increase in the border region between the containing portion 31 and the ejecting portion 32. As a result of providing the recessed portion 81 in the containing portion 31, the change in the cross-sectional area between the containing portion 31 and the ejecting portion 32 is smoothed at the recessed portion 81. Therefore, pressure loss can be reduced. Accordingly, the concentrated stock solution contained in the containing portion 31 smoothly flows down to the ejecting portion 32.

In addition, internal pressure generated by to the concentrated stock solution contained in the containing portion 31 and the concentrated stock solution that flows through the ejecting portion 32 is exerted on the inner faces of the containing portion 31 and the ejecting portion 32, outward of the containing portion 31 and the ejecting portion 32. At this time, the internal pressure is exerted on the inner face of the protruding portion 82, and the containing portion 31 and the ejecting portion 32 are opened in the thickness direction, enabling the concentrated stock solution contained in the containing portion 31 to reliably flow down to the ejecting portion 32, and enabling the liquid that flows through the ejecting portion 32 to reliably flow down to the ejection port 35.

As shown in FIG. 12, the ejecting portion 32 has, at its leading end, a plurality of linear reinforcing portions 83, which are parallel to the axial direction of the ejecting portion 32.

The reinforcing portions 83 are obtained by, for example, heat-pressing, in advance, the sheets that constitute the stock solution container 30 to form their shape.

The reinforcing portions 83 can reduce shaking of the leading end of the ejecting portion 32 when the concentrated stock solution is ejected.

Note that the stock solution container 30 does not need to have all of the recessed portion 81, the protruding portion 82, and the reinforcing portions 83 at a time, and may be configured to have only one of the recessed portion 81, the protruding portion 82, and the reinforcing portions 83, or a combination of two of the recessed portion 81, the protruding portion 82, and the reinforcing portions 83. In the case of having the protruding portion 82, a configuration may be employed in which the stock solution container 30 has the protruding portion 82 only in the containing portion 31, and does not have the protruding portion 82 in the ejecting portion 32.

Figure 15:
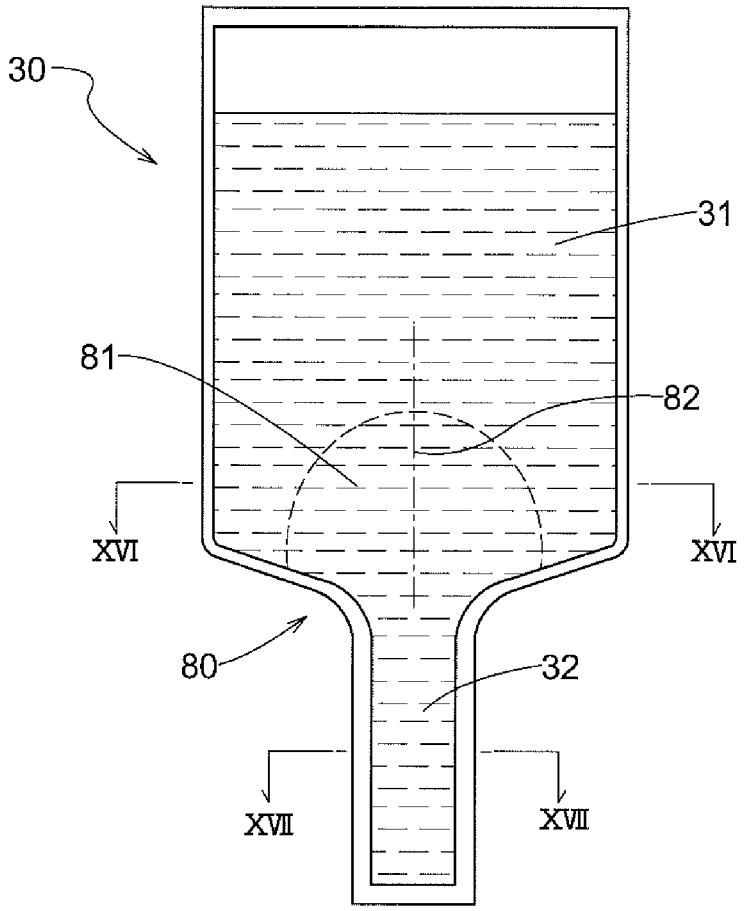
FIG. 15 is a diagram illustrating a stock solution container according to another embodiment.
Figure 16:
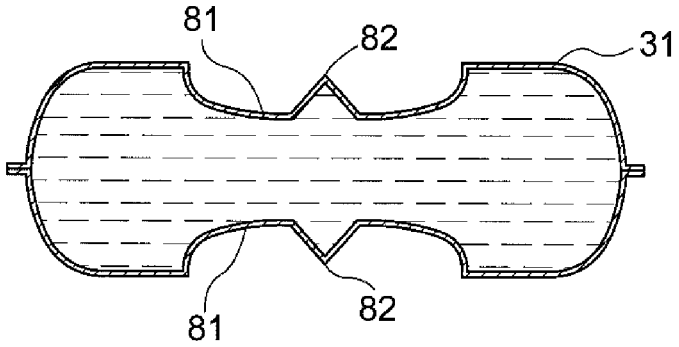
FIG. 16 is a diagram illustrating the stock solution container according to the other embodiment, as viewed in the direction of arrows XVI-XVI in FIG. 15.
Figure 17:
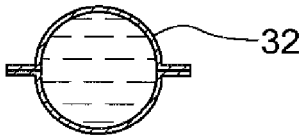
FIG. 17 is a diagram illustrating the stock solution container according to the other embodiment, as viewed in the direction of arrows XVII-XVII in FIG. 15.

FIGS. 15 to 17 show a stock solution container 30 according to another embodiment of the stock solution container 30 shown in FIG. 12.

As shown in FIGS. 15 and 16, the stock solution container 30 also has the recessed portion 81 and the protruding portion 82. Note that the protruding portion 82 of the stock solution container 30 is only provided in the containing portion 31.

The ejecting portion 32 of the stock solution container 30 is configured so that its cross-section in the direction perpendicular to the axial direction of the ejecting portion 32 is circular, as shown in FIG. 17. That is to say, since the internal space of the ejecting portion 32 is cylindrical, the liquid that flows through the ejecting portion 32 can be caused to reliably flow down to the ejection port 35.

Note that this ejecting portion 32 can be obtained by, for example, heat-pressing, in advance, the sheets that constitute the stock solution container 30 to form their shape.

The above-described recessed portion 81, protruding portion 82, and reinforcing portions 83 or ejecting portion 32 can also be employed in the above-described stock solution container 30 shown in FIGS. 7 to 10.

Figure 18:
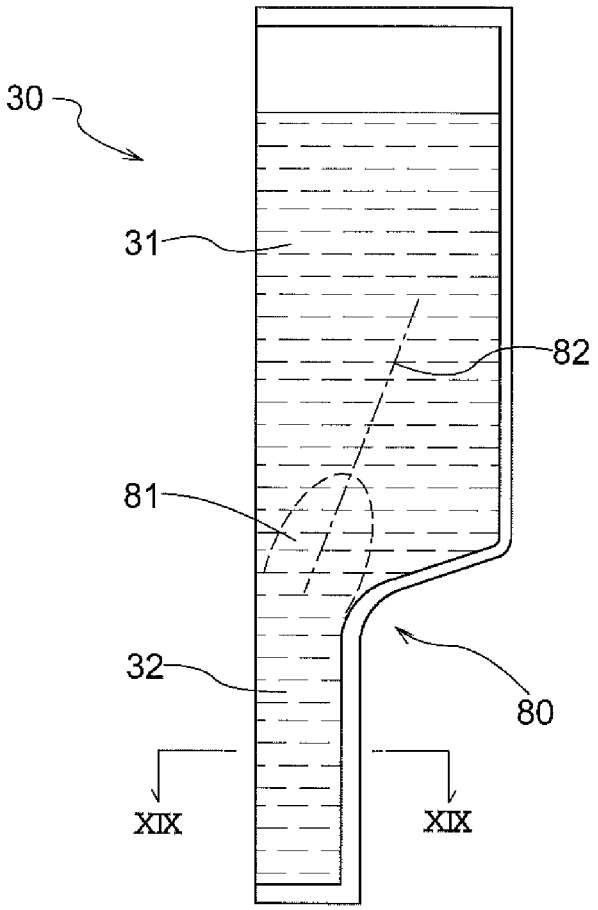
FIG. 18 is a diagram illustrating a stock solution container according to another embodiment.
Figure 19:
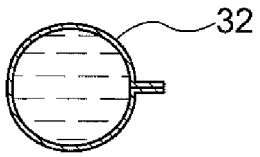
FIG. 19 is a diagram illustrating the stock solution container according to the other embodiment, as viewed in the direction of arrows XIX-XIX in FIG. 18.

For example, as shown in FIG. 18, the recessed portion 81, the protruding portion 82, and the ejecting portion 32 can be employed in the stock solution container 30 shown in FIG. 8.

The above embodiment has been described while taking, as an example, the case where the liquid contained in the stock solution container 30 is a concentrated stock solution that constitutes a beverage by being diluted with a diluent, and the stock solution container 30 is a container that contains the concentrated stock solution. However, the invention is not limited thereto. A beverage may be contained as-is as the liquid in a container. In this case, the beverage dispenser 1 may not include diluent supply mechanisms such as the drinking water supply mechanism and the carbonated water supply mechanism, the cooling mechanism for cooling the carbonated water supply mechanism, and the like.

All of the above embodiments are examples of the present invention, and the present invention is not limited to the description thereof. The specific configurations of each section can be modified or designed as appropriate within a scope where the effects of the present invention are obtainable.

DESCRIPTION OF REFERENCE SIGNS

1 Beverage dispenser (liquid dispenser)
2 Dispenser body
4 Accommodating portion
5 Stock solution ejection mechanism (liquid ejection mechanism)
7 Drinking water supply mechanism
8 Drinking water supply line
9 Gas cylinder
10 Gas supply line
12 Branch line
13 Carbonated water supply mechanism
14 Carbonated water supply line
30 Stock solution container (container)
31 Containing portion
32 Ejecting portion
33 Suspension hole
34 Cutout portion
35 Ejection port
41 Pinch valve
42 Pinch valve
C Cup

The invention claimed is:

1. A container that is to contain a liquid and is to be used in a liquid dispenser for ejecting the liquid from the container containing the liquid, comprising:

a containing portion that has a bag shape and is to contain the liquid; and an ejecting portion for ejecting the liquid to the outside, the ejecting portion being provided so as to protrude from the containing portion and is in fluid communication with the containing portion, wherein the containing portion and the ejecting portion are formed of one folded flexible resin sheet or a plurality of flexible resin sheets laid over one another, a peripheral portion of the folded resin sheet or laid resin sheets is formed inseparable, a cross-sectional area of the ejecting portion in a direction perpendicular to an axial direction of the ejecting portion is set to be narrower than that of the containing portion, an ejection port is provided at a leading end of the ejecting portion, the liquid is ejected from the ejection port as the containing portion deforms based on an external force, and the containing portion has: in a region bordering the ejecting portion, a transitional portion whose cross-sectional area in the direction perpendicular to the axial direction of the ejecting portion smoothly decreases from the containing portion to the ejecting portion; a recessed portion that expands in a fan shape around a center of the transitional portion and is recessed in a thickness direction of the containing portion; and a protruding portion that vertically divides the transitional portion and externally protrudes as viewed in a cross-section in the direction perpendicular to the axial direction of the ejecting portion.

2. The container according to claim 1, wherein the ejecting portion is configured so that a volume of the liquid to be contained in the ejecting portion is a volume that corresponds to an amount of liquid that is ejected at a time from the liquid dispenser when the container is used in the liquid dispenser.

3. The container according to claim 1, wherein a lower end of the protruding portion reaches the leading end of the ejecting portion.

4. The container according to claim 1, wherein a cross-section of the ejecting portion in the direction perpendicular to the axial direction of the ejecting portion is configured to be circular.

5. The container according to claim 1, wherein the ejecting portion has, at the leading end of the ejecting portion, a linear reinforcing portion that is parallel to the axial direction of the ejecting portion.

6. The container according to claim 1, wherein the containing portion and the ejecting portion are made of a resin that has transparency.

7. The container according to claim 1, wherein a cutout portion capable of being used to form the ejection port is provided in a part of the peripheral portion included in the ejecting portion near the leading end of the ejecting portion.

8. The container according to claim 1, wherein a suspension hole for hanging the container on a hook provided in the liquid dispenser is provided in a part of the peripheral portion included in the containing portion on a side opposite to the ejecting portion.

9. The container according claim 1, wherein the liquid is a beverage.

10. The container according to claim 1, wherein the liquid is a concentrated stock solution that constitutes a beverage by being mixed with a diluent.

11. The container according to claim 1, wherein a relief valve is arranged in a flow path from the ejecting portion to the ejecting port, in the ejecting portion on an ejection port side.

* * * * *